US012292223B2

(12) United States Patent
Kim et al.

(10) Patent No.: US 12,292,223 B2
(45) Date of Patent: May 6, 2025

(54) REFRIGERATOR

(71) Applicant: LG Electronics Inc., Seoul (KR)

(72) Inventors: Ki Hwang Kim, Seoul (KR); Sung Hee Kang, Seoul (KR); Won Ho Park, Seoul (KR)

(73) Assignee: LG Electronics Inc., Seoul (KR)

( * ) Notice: Subject to any disclaimer, the term of this patent is extended or adjusted under 35 U.S.C. 154(b) by 207 days.

(21) Appl. No.: 17/917,692

(22) PCT Filed: Sep. 17, 2020

(86) PCT No.: PCT/KR2020/012587
§ 371 (c)(1),
(2) Date: Oct. 7, 2022

(87) PCT Pub. No.: WO2021/206238
PCT Pub. Date: Oct. 14, 2021

(65) Prior Publication Data

US 2023/0152024 A1 May 18, 2023

(30) Foreign Application Priority Data

Apr. 8, 2020 (KR) ..... 10-2020-0042530

(51) Int. Cl.
*F25D 17/06* (2006.01)

(52) U.S. Cl.
CPC ..... *F25D 17/065* (2013.01); *F25D 2317/063* (2013.01); *F25D 2317/067* (2013.01); *F25D 2317/0682* (2013.01)

(58) Field of Classification Search
CPC ..... F25D 17/065; F25D 17/067; F25D 17/08; F25D 17/045; F25D 2317/063; F25D 2317/067; F25D 2317/0682; F25D 2317/06; F25D 2317/0671; F25D 2317/0672
See application file for complete search history.

(56) References Cited

U.S. PATENT DOCUMENTS 6,381,982 B1 * 5/2002 Kim ..... F25D 17/065 62/411
2009/0113924 A1 * 5/2009 Bae ..... F25D 17/065 29/890.035
2023/0349622 A1 * 11/2023 Kim ..... F25D 17/065

FOREIGN PATENT DOCUMENTS

| | | |
|---|---|---|
| EP | 2205914 | 11/2019 |
| JP | 2020034207 | 3/2020 |
| KR | 20070072239 | 7/2007 |

OTHER PUBLICATIONS

Extended European Search Report in European AppIn. No. 20930370.0, dated Mar. 11, 2024, 9 pages.

* cited by examiner

*Primary Examiner* — Miguel A Diaz
(74) *Attorney, Agent, or Firm* — Fish & Richardson P.C.

(57) ABSTRACT

A refrigerator includes a cool air passage for guiding the flow of cool air to a freezing compartment and a cool air passage for guiding the flow of cool air to an ice-making compartment that partially share the cool air. Through the sharing of cool air, the amount of cool air supplied to the freezing compartment is increased and sufficient cool air is supplied to the refrigerating compartment. Accordingly, sufficient cool air is supplied to the refrigerating compartment, the freezing compartment, and the ice-making compartment even with a single evaporator.

19 Claims, 32 Drawing Sheets

REFRIGERATOR

CROSS-REFERENCE TO RELATED APPLICATIONS

This application is a National Stage application under 35 U.S.C. § 371 of International Application No. PCT/KR2020/012587, filed on Sep. 17, 2020, which claims the benefit of Korean Patent Application No. 10-2020-0042530, filed on Apr. 8, 2020. The disclosures of the prior applications are incorporated by reference in their entirety.

TECHNICAL FIELD

The present disclosure relates to a refrigerator having a refrigerating compartment and a freezing compartment that respectively provide storage spaces and having an ice-making compartment provided in a refrigerating compartment door.

BACKGROUND ART

Generally, a refrigerator is a home appliance that is provided to store various foods or beverages for a long time by cool air generated by circulation of a refrigerant according to a refrigeration cycle.

The refrigerator is configured of one or a plurality of partitioned storage compartments for cooling an object to be stored. Each of the storage compartments may be opened or closed by a rotary type door, or may be ejected and retracted or store in a drawer manner.

In particular, the storage compartments may include a freezing compartment for freezing the object to be stored and a refrigerating compartment for refrigerating the object to be stored. In addition, the storage compartments may include at least two freezing compartments or at least two refrigerating compartments.

In recent refrigerators, an ice-making compartment is provided in a refrigerating compartment door so that a user can take out ice without opening the freezing compartment.

That is, cool air has passed through an evaporator in a cabinet is delivered to the refrigerating compartment door through a cool air duct for the ice-making compartment, and when the refrigerating compartment door is closed, the cool air is supplied to the ice-making compartment through a connection passage provided in the refrigerating compartment door by the cool air duct for the ice-making compartment.

The above refrigerator is proposed in various related art, such as Korean Patent No. 10-1639443, Korean Patent Application Publication No. 10-2009-0101525, and Korean Patent No. 10-1659622.

In particular, the above-described refrigerator having the ice-making compartment at the refrigerating compartment door is configured to selectively supply cool air to the refrigerating compartment, the freezing compartment, and the ice-making compartment by using a single evaporator.

However, the refrigerator according to the above related art has a problem in that sufficient cool air is not supplied to the freezing compartment due to the configuration in which cool air is supplied to the three compartments using the single evaporator.

Even though the freezing compartment having an inside space larger than that of the ice-making compartment should receive sufficient cool air than the ice-making compartment, cool air is not sufficiently provided to the freezing compartment.

Further, in the above related art, the refrigerator is configured such that cool air that has passed through the ice-making compartment provided in the refrigerating compartment door is recovered to the freezing compartment.

However, since the recovered cool air has a temperature higher than the temperature in the freezing compartment, temperature difference between a portion where the cool air is recovered and other portions in the freezing compartment should occur. Therefore, it is difficult to accurately control the temperature in the freezing compartment.

In particular, as interference generated in the process in which the cool air recovered from the ice-making compartment flows into the freezing compartment acts on the flow of the cool air in the freezing compartment, there is a problem in that sufficient cool air is not supplied to a specific portion in the freezing compartment.

Meanwhile, in the refrigerator having the ice-making compartment at the refrigerating compartment door, a freezing fan module and an ice-making fan module are provided separately and then coupled to a shroud.

In particular, the ice-making fan module includes a passage for guiding cool air to the ice-making compartment.

However, a grille fan assembly provided by coupling the separate ice-making fan module to the shroud as described above has a problem in assembling in that the ice-making fan module should be additionally assembled. Further, in the process of installing the ice-making module in the grille fan assembly, there is a problem in that a fan duct does not match with a cool air duct for the ice-making compartment due to a coupling error between the ice-making fan module and the grille fan assembly.

Further, in the refrigerator having the ice-making compartment at the refrigerating compartment door, a large amount of condensed water is generated in the ice-making fan module due to humid air flowing back from the refrigerating compartment through the cool air duct for the ice-making compartment during the freezing operation. The generated condensed water freezes to cause a malfunction of the ice-making fan.

Conventionally, various efforts have been carried out for removing condensed water in a portion where the ice-making fan module is located or for preventing the freezing of the condensed water.

However, despite the above efforts, a structure that prevents the back flow of cool air from the cool air duct for the ice-making compartment or a structure for quickly removing the condensed water flowing into the ice-making fan module is not provided in the refrigerator, so the above problems still remain.

DISCLOSURE

Technical Problem

Accordingly, the present disclosure has been made keeping in mind the above problems occurring in the prior art, and an objective of the present disclosure is to provide a refrigerator in which a cool air passage for a freezing compartment guiding a cool air flow to a freezing compartment and the cool air passage for an ice-making compartment guiding a cool air flow to the ice-making compartment partially share cool air with each other. Whereby, when an ice-making fan and a freezing fan are operated at the same time, part of the cool air supplied through the cool air passage for the ice-making compartment is supplied to the freezing compartment through the cool air passage for the freezing compartment, and even when only the ice-making fan is operated, the cool air in the freezing compartment is prevented from flowing back into the cool air passage for the ice-making compartment.

Another objective of the present disclosure is to provide a refrigerator capable of minimizing the interference in which of part of the cool air supplied to the cool air passage for the freezing compartment by the ice-making fan interferes with the flow of cool air flowing in the cool air passage for the freezing compartment by the freezing fan.

A further objective of the present disclosure is to provide a refrigerator in which a condensed water discharge structure is provided in a portion where an ice-making fan module is located. Accordingly, even when condensed water is generated around the ice-making fan module, the ice-making fan module is prevented from freezing.

Technical Solution

In the refrigerator of the present disclosure in order to achieve the above objectives, cool air is supplied to a refrigerating compartment, a freezing compartment, and an ice-making compartment by a single evaporator, a cool air passage for the freezing compartment supplying cool air to the refrigerating compartment and the freezing compartment and a cool air passage for the ice-making compartment supplying cool air to the ice-making compartment share the cool air with each other through a shared passage. Thus, the amount of the cool air supplied to the freezing compartment is increased, and when only an ice-making fan is operated, the cool air in the freezing compartment is prevented from flowing back.

In the refrigerator of the present disclosure, an open portion at a cool air outlet side of the shared passage may be configured not to face a freezing fan. Thus, the cool air supplied to the cool air passage for the freezing compartment from the cool air passage for the ice-making compartment through the shared passage is smoothly supplied without interference with the cool air flowing along the cool air passage for the freezing compartment.

In the refrigerator of the present disclosure, the cool air passage for the freezing compartment and the cool air passage for the ice-making compartment may be provided at one surface of facing surfaces of a grille panel and a shroud. Whereby, inconvenience in assembling or poor assembly is prevented.

In the refrigerator of the present disclosure, a refrigerating compartment side grille fan assembly may be configured to receive cool air from a freezing compartment side grille fan assembly through a connection duct. Whereby, the refrigerating compartment, the freezing compartment, and the ice-making compartment are cooled by the single evaporator.

In the refrigerator of the present disclosure, a cool air outlet may be configured to be positioned at a portion in an upper surface of the freezing compartment side grille fan assembly, the portion being directly above the freezing fan. Whereby, sufficient cool air is supplied to the refrigerating compartment side grille fan assembly.

In the refrigerator of the present disclosure, an upper guide may be provided on the freezing compartment side grille fan assembly. Whereby, the flow of cool air due to the operation of the freezing fan smoothly flows into the cool air outlet and an upper space of the cool air passage for the freezing compartment.

A passage opening and closing module may be provided in the refrigerator of the present disclosure, the passage opening and closing module selectively blocking the cool air supplied to the refrigerating compartment side grille fan assembly through the connection duct. Whereby, the refrigerating operation and the freezing operation are performed separately by the single evaporator.

A passage rib may be included in the refrigerator of the present disclosure. Whereby, the cool air passage for the freezing compartment and the cool air passage for the ice-making compartment are separated from each other.

In the refrigerator of the present disclosure, an upper shared passage may be formed on one port ion of the passage rib. Whereby, the upper shared passage is provided.

The refrigerator of the present disclosure may include a first circumferential passage rib surrounding an upper circumference of an ice-making fan module, and a second circumferential passage rib surrounding a lower circumference of the ice-making fan module. Whereby, the cool air passage for the ice-making compartment is provided.

In the refrigerator of the present disclosure, a lower end of the first circumferential passage rib and an upper end of the second circumferential passage rib may be configured to be spaced apart from each other. Whereby, the upper shared passage is provided.

In the refrigerator of the present disclosure, the upper end of the second circumferential passage rib may be configured to surround an outer circumferential surface of the lower end of the first circumferential passage rib. Whereby, the upper shared passage may discharge cool air to an upper surface at one side in the cool air passage for the freezing compartment.

In the refrigerator of the present disclosure, the upper end of the second circumferential passage rib may be configured to be located higher than a center height of the freezing fan. Whereby, the cool air blown in a radial direction of the freezing fan due to the operation of the freezing fan is prevented from interfering the cool air discharge while flowing back to the upper shared passage through a cool air outlet side of the upper shared passage.

In the refrigerator of the present disclosure, the upper end of the second circumferential passage rib may be configured to be gradually further spaced apart from the lower end of the first circumferential passage rib as the second circumferential passage rib goes upward. Whereby, the discharge flow rate of the cool air supplied to the cool air passage for the freezing compartment may be reduced, and interference with the flow of the cool air flowing along the cool air passage for the freezing compartment is prevented.

A lower shared passage may be included in the refrigerator of the present disclosure. Thus, part of cool air generated in the cool air passage for the ice-making compartment is provided to an extension passage.

In the refrigerator of the present disclosure, the lower shared passage may be configured such that a lower end of the second circumferential passage rib is spaced apart from a wall surface of the cool air passage for the freezing compartment. Thus, the cool air supplied through the lower shared passage may flow along the wall surface of the cool air passage for the freezing compartment.

A recovery duct for the refrigerating compartment may be included in the refrigerator of the present disclosure, the recovery duct being configured to recover the cool air in the refrigerating compartment to a cool air inlet side of the evaporator. Thus, the load of the evaporator may be reduced.

In the refrigerator of the present disclosure, the upper guide may be included on an upper wall surface of the cool air passage for the freezing compartment. Thus, the cool air may be smoothly discharged through the cool air outlet.

Advantageous Effects

As described above, the shared passages are provided in the refrigerator of the present disclosure, so that the cool air passage for the freezing compartment and the cool air passage for the ice-making compartment are shared with each other. Accordingly, even when the freezing fan and the ice-making fan are operated at the same time, sufficient cool air can be supplied to the freezing compartment, and when only the ice-making fan is operated, the back flow of cool air from the freezing compartment can be prevented.

The refrigerator of the present disclosure is configured such that the open portion of the cool air outlet side of the shared passage does not face the freezing fan module. Accordingly, there is an effect that the cool air provided from the cool air passage for the ice-making compartment through the shared passage does not interfere with the flow of the cool air flowing in the cool air passage for the freezing compartment.

The refrigerator of the present disclosure is configured such that the lower shared passage is formed in a lower surface (the second circumferential passage rib) of the installation portion of the ice-making fan module, and the extension passage extended to the lower compartment of the freezing compartment is additionally formed in the shroud. Therefore, sufficient cool air can be supplied to the lower compartment of the freezing compartment.

In particular, the drainage hole is additionally formed in the extension passage, and the lower shared passage is formed by penetrating between the second circumferential passage rib and the wall surface of the shroud.

Accordingly, there is an effect that condensed water or moisture in the installation portion of the ice-making fan module can be smoothly discharged to the outside of the freezing compartment.

The refrigerator of the present disclosure is configured to have the guide formed on each wall surface in the cool air passage for the freezing compartment, so that the cool air flowing in the cool air passage for the freezing compartment can be supplied differently for each portion in the freezing compartment. Accordingly, there is an effect that the freezing efficiency can be improved.

The refrigerator of the present disclosure is configured to supply the cool air to the cool air passage for the refrigerating compartment of the refrigerating compartment side grille fan assembly through the cool air outlet formed in the upper wall surface of the cool air passage for the freezing compartment and the connection duct connected to the cool air outlet. Accordingly, there is an effect that the single evaporator can selectively supply cool air to the refrigerating compartment, the freezing compartment, and the ice-making compartment.

DESCRIPTION OF DRAWINGS

FIG. 1I is a side view showing the refrigerator according to the embodiment of the present disclosure in a state in which the outer casing is removed for showing the installation structure of the cool air duct for the ice-making compartment, the recovery duct for the ice-making compartment, the connection duct, and the recovery duct for the refrigerating compartment;

MODE FOR INVENTION

Hereinbelow, an exemplary embodiment with respect to a refrigerator of the present disclosure will be described in detail with reference to accompanying FIGS. 1 to 36.

Figure 1:
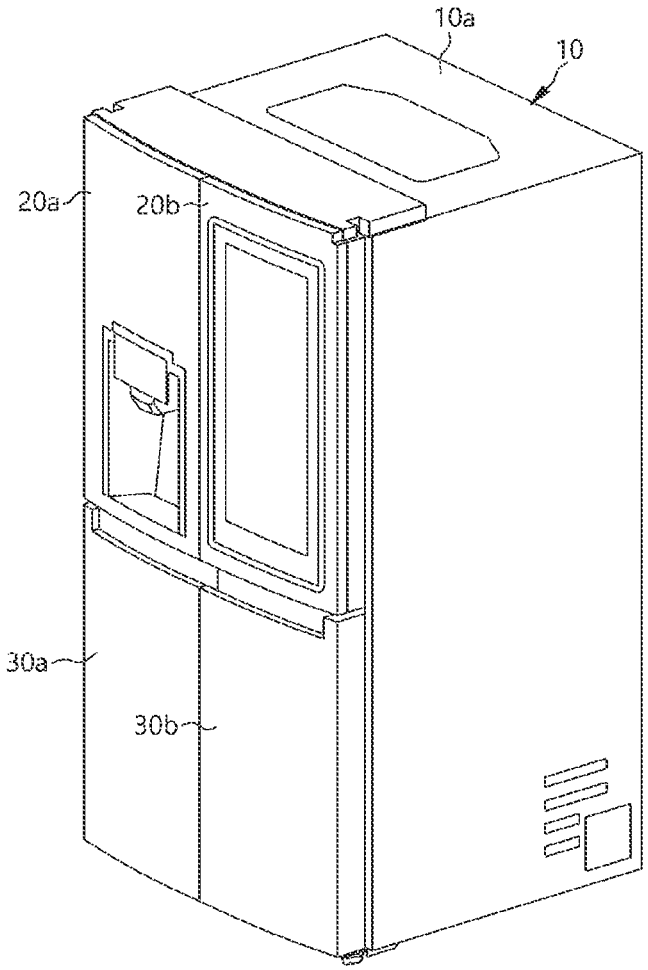
FIG. 1 is a perspective view showing an external appearance of a refrigerator according to an embodiment of the present disclosure.
Figure 2:
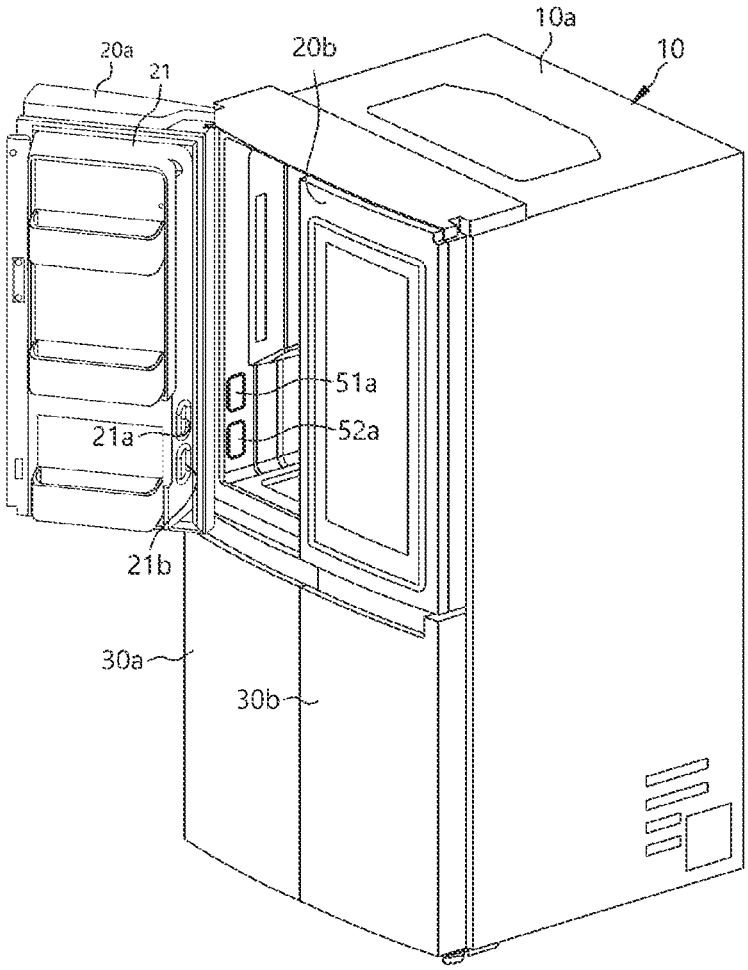
FIG. 2 is a perspective view showing a state in which a refrigerating compartment door with an ice-making compartment of the refrigerator according to the embodiment of the present disclosure is opened.

FIG. 1 is a perspective view showing an external appearance of the refrigerator according to the embodiment of the present disclosure. FIG. 2 is a perspective view showing a state in which a refrigerating compartment door at an ice-making compartment of the refrigerator according to the embodiment of the present disclosure.

Figure 3:
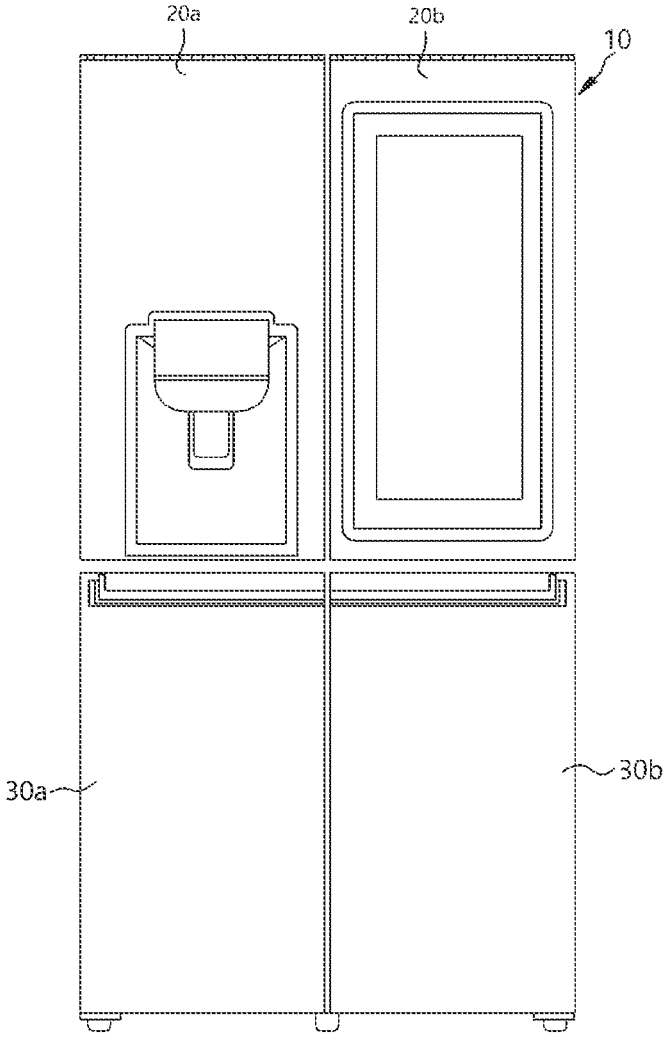
FIG. 3 is a front view schematically showing an inner structure of the refrigerator according to the embodiment of the present disclosure.
Figure 4:
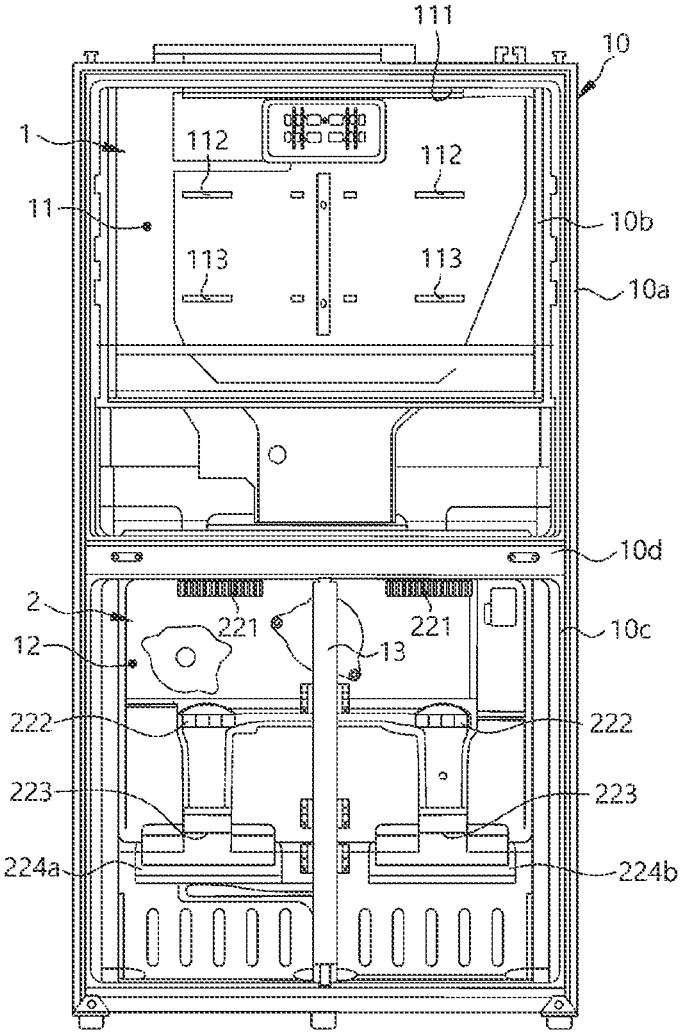
FIG. 4 is a front view showing the inner structure of the refrigerator according to the embodiment of the present disclosure in a state in which two refrigerating compartment doors and two freezing compartment doors are omitted.
Figure 5:
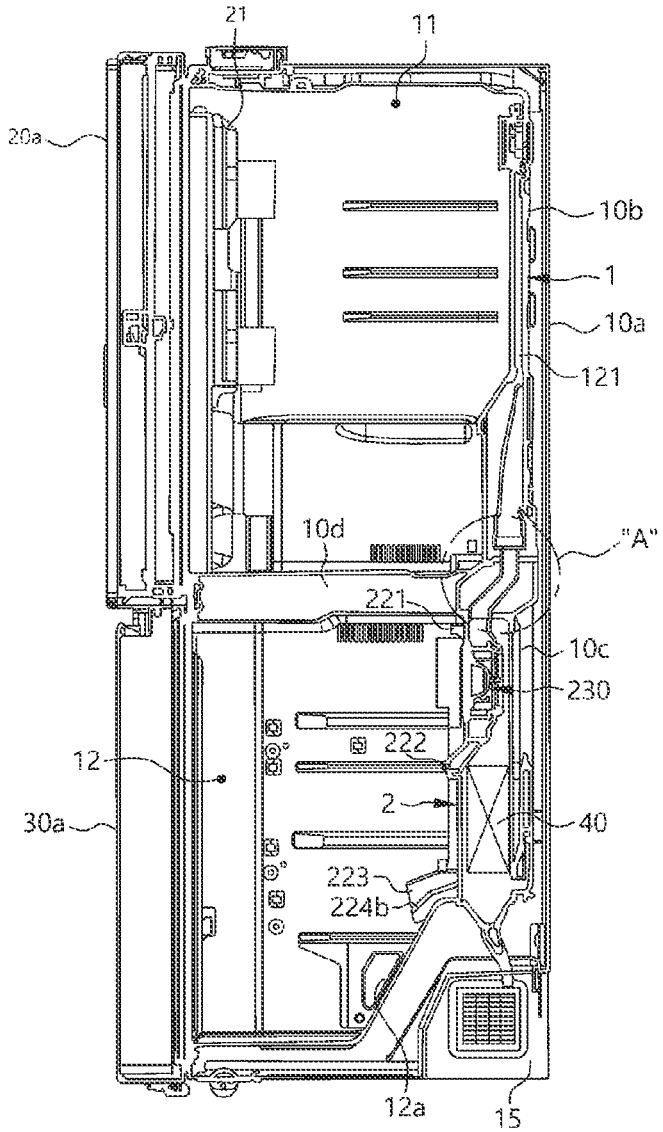
FIG. 5 is a side section view showing the inner structure of the refrigerator according to the embodiment of the present disclosure.

FIG. 3 is a front view schematically shown for showing an inner structure of the refrigerator according to the embodiment of the present disclosure. FIG. 4 is a front view showing the inner structure of the refrigerator according to the embodiment of the present disclosure in a state in which two refrigerating compartment doors and two freezing compartment doors are omitted. FIG. 5 is a side section view showing the inner structure of the refrigerator according to the embodiment of the present disclosure.

As shown in the drawings, the refrigerator according to the embodiment of the present disclosure includes a refrigerating compartment 11, a freezing compartment 12, and an ice-making compartment 21. The refrigerating compartment 11 is configured to receive cool air from a refrigerating compartment side grille fan assembly 1. The ice-making compartment 21 is configured to be located in any one refrigerating compartment door 20*a* and to receive cool air from a freezing compartment side grille fan assembly 2 together with the freezing compartment 12.

In addition, the cool air is generated from a single evaporator 40 and then supplied into the refrigerating compartment 11, the freezing compartment 12, and the ice-making compartment 21 through the refrigerating compartment side grille fan assembly 1 and the freezing compartment side grille fan assembly 2. The freezing compartment side grille fan assembly 2 is configured such that a cool air passage 214 for the freezing compartment and a cool air passage 213 for the ice-making compartment are integrally formed and share the cool air with each other through a shared passage 215*a*, 215*b*.

That is, as the cool air passage 214 for the freezing compartment and the cool air passage 213 for the ice-making compartment share the cool air with each other, the cool air may be selectively supplied from the single evaporator 40 to the refrigerating compartment 11, the freezing compartment 12, and the ice-making compartment 21. Further, as the cool air supplied to the ice-making compartment 21 may be supplied to the freezing compartment 12, enough cool air may be supplied to the freezing compartment 12.

The refrigerator according to the embodiment of the present disclosure will be described in detail as follows.

First, the refrigerating compartment 11 is a storage compartment provided to refrigerate the object to be stored, and the freezing compartment 12 is a storage compartment provided to freeze the object to be stored.

The refrigerating compartment 11 is provided in an upper space in a cabinet 10, and the freezing compartment 12 is provided in a lower space in the cabinet 10.

The cabinet 10 may consist of an outer casing 10*a* forming an external surface of the refrigerator and two inner casings 10*b* and 10*c* forming an inner surface of the refrigerator.

In the two inner casings 10*b* and 10*c*, an upper inner casing 10*b* (Hereinbelow, upper inner casing refers to "inner casing for refrigerating compartment") is a portion providing the refrigerating compartment 11, and a lower inner casing 10*c* (Hereinbelow, lower inner casing refers to "inner casing for freezing compartment") is a portion providing the freezing compartment 12.

That is, an inside space of the inner casing 10*b* for the refrigerating compartment is used as the refrigerating compartment 11, and an inside space of the inner casing 10*c* for the freezing compartment is used as the freezing compartment 12.

The inner casing 10*b* for the refrigerating compartment and the inner casing 10*c* for the freezing compartment is formed in a box shape with an open front surface, and is formed to be spaced apart from each other.

A partition wall 10*d* (referring to FIGS. 4 and 5) may be provided in a space between the two inner casings 10*b* and 10*c*. The partition wall 10*d* may be a separate frame placed between the two inner casings 10*b* and 10*c*, may be a filling material filling between the two inner casings 10*b* and 10*c*, or may be configured as a void.

Further, the refrigerating compartment 11 is configured to be opened and closed by a refrigerating compartment door 20*a*, 20*b*, and the freezing compartment 12 is configured to be opened and closed by a freezing compartment door 30*a*, 30*b*.

The refrigerating compartment door 20*a*. 20*b* is configured as two doors, and configured as double-door type rotary doors (a door installed to be horizontally rotatable) that may respectively open and close opposite sides of the refrigerating compartment 11. The freezing compartment door 30*a*, 30*b* may be configured as two doors, and configured as double-door type rotary doors (a door installed to be horizontally rotatable) that may respectively open and close opposite sides of the freezing compartment 12.

In particular, the ice-making compartment 21 is provided at an inside (a side located in the refrigerating compartment when the refrigerating compartment door is closed) of either refrigerating compartment door 20*a* (Hereinbelow, the door refers to a "first refrigerating compartment door") of the two refrigerating compartment doors 20*a* and 20*b*. The ice-making compartment 21 is a storage compartment having an ice tray (not shown) for making ice at a refrigerating compartment door 20*a*. The ice-making compartment 21 is configured to have a space partitioned from the refrigerating compartment 11. The first refrigerating compartment door 20*a* is a refrigerating compartment door located on the left side when the refrigerator is viewed from the front.

Although not shown in the drawings, the ice-making compartment 21 may be additionally provided in another refrigerating compartment door 20*b* (a refrigerating compartment door is located on the right side when the refrigerator is viewed from the front. Hereinbelow, the refrigerating compartment door refers to "second refrigerating compartment door") of the refrigerating compartment doors 20*a* and 20*b*. The ice-making compartment 21 may be configured to be provide in only the second refrigerating compartment door 20*b*.

Further, the freezing compartment 12 is configured to have seated portions of an upper compartment, a middle compartment, and a lower compartment.

In addition, a separation wall 13 is provided in the freezing compartment 12. The separation wall 13 is a wall built for dividing the freezing compartment 12 into left and right spaces, and is configured to vertically cross a center portion in the freezing compartment 12.

The left and right spaces in the freezing compartment 12 divided by the separation wall 13 are respectively configured as seated portions of the upper, middle, and lower compartments. In each of the seated portions of the upper, middle, and lower compartments, a drawer box (not shown) may be provided to store the objects to be stored.

The drawer box may be installed to be ejected and retracted in a drawer manner. The drawer box in each of the compartments may be configured such that an upper end of the drawer box is spaced apart from a lower surface of another drawer box that is located on an upper side thereof. That is, through the space between the drawer boxes, cool air may pass between the drawer boxes of the compartments.

The two freezing compartment doors 30*a* and 30*b* are configured to open and close the opposite spaces in the freezing compartment 12 divided by the separation wall 13, respectively. That is, one freezing compartment door 30*a* (Hereinbelow, the door refers to "first freezing compartment door") is configured to open and close one side space in the freezing compartment (the left side space viewed from the front). Further, another freezing compartment door 30*b* (Hereinbelow, the door refers to "second freezing compartment door") is configured to open and close another side space in the freezing compartment (the right-side space viewed from the front).

Further, the evaporator 40 is provided in the cabinet 10.

The evaporator 40 may be located in the rear side (the rear side in the freezing compartment) in the inner casing 10*c* for the freezing compartment. In more detail, the evaporator 40 may be located above a machine room 15.

The machine room 15 is provided in a lower rear portion outside the inner casing 10*c* for the freezing compartment and provides a space in which a compressor and a condenser are installed.

The lower rear portion in the freezing compartment 12 has a freezing space that is narrower than an upper rear port ion in the freezing compartment 12 by the size of the machine room 15. That is, the upper portion in the freezing compartment 12 is formed by protruding rearward more than the lower portion in the freezing compartment 12, and the evaporator 40 is located in the upper rear portion in the freezing compartment 12.

Further, a recovery duct 53 for the refrigerating compartment is provided in the cabinet 10.

The recovery duct 53 for the refrigerating compartment is provided to recover the cool air flowing in the refrigerating compartment 11 toward a cool air inlet side of the evaporator 40.

A first end of the recovery duct 53 for the refrigerating compartment is configured to be connected to a lower end of a rear surface of the inner casing 10*b* for the refrigerating compartment constituting the cabinet 10. A second end of the recovery duct 53 for the refrigerating compartment is configured to be connected to the cool air inlet side (a lower portion of the evaporator) of the evaporator 40 of a rear surface of the inner casing 10*c* for the freezing compartment constituting the cabinet 10.

The first end of the recovery duct 53 for the refrigerating compartment is configured to be connected to a side portion of a connect ion duct 54. The connection duct 54 is a configuration provided in the cabinet 10 to provide cool air generated from the freezing compartment side grille fan assembly 2 to the refrigerating compartment side grille fan assembly 1.

The connection duct 54 may be provided in the refrigerating compartment side grille fan assembly 1 or in the freezing compartment side grille fan assembly 2. The connection duct 54 may be formed separately from the cabinet 10 and the two grille fan assemblies 1 and 2 and then may be connected to the two grille fan assemblies 1 and 2.

Further, the freezing compartment side grille fan assembly 2 is provided in front of the evaporator 40.

The freezing compartment side grille fan assembly 2 is configured to selectively supply cool air to the freezing compartment 12 and the ice-making compartment 21 while two fan modules 230 and 240 are simultaneously installed therein.

That is, the two fan modules 230 and 240 are simultaneously provided in the single freezing compartment side grille fan assembly 2, and a structure for guiding a flow of cool air blown by the two fan modules 230 and 240 allows the two fan modules 230 and 240 to be integrally formed in the freezing compartment side grille fan assembly 2.

Further, a cool air duct 51 for the ice-making compartment is provided in a gap between the outer casing 10*a* and any one side wall of the two inner casings 10*b* and 10*c* constituting the cabinet 10.

The cool air duct 51 for the ice-making compartment is a duct that guides the cool air provided from the freezing compartment side grille fan assembly 2 to be supplied to the ice-making compartment 21.

Figure 8:
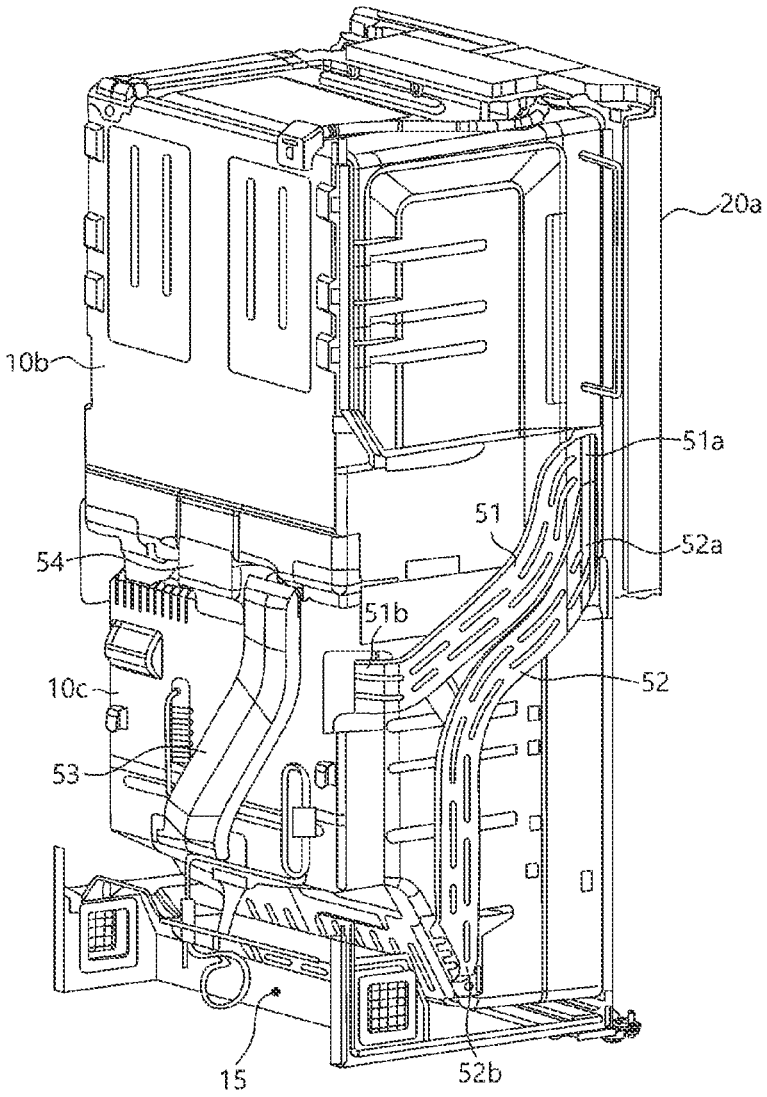
FIG. 8 is a perspective view from a rear surface of the refrigerator, the view showing a state in which an outer casing is removed for showing an installation structure of a cool air duct for the ice-making compartment, a recovery duct for the ice-making compartment, a connection duct, and a recovery duct for the refrigerating compartment.
Figure 11:
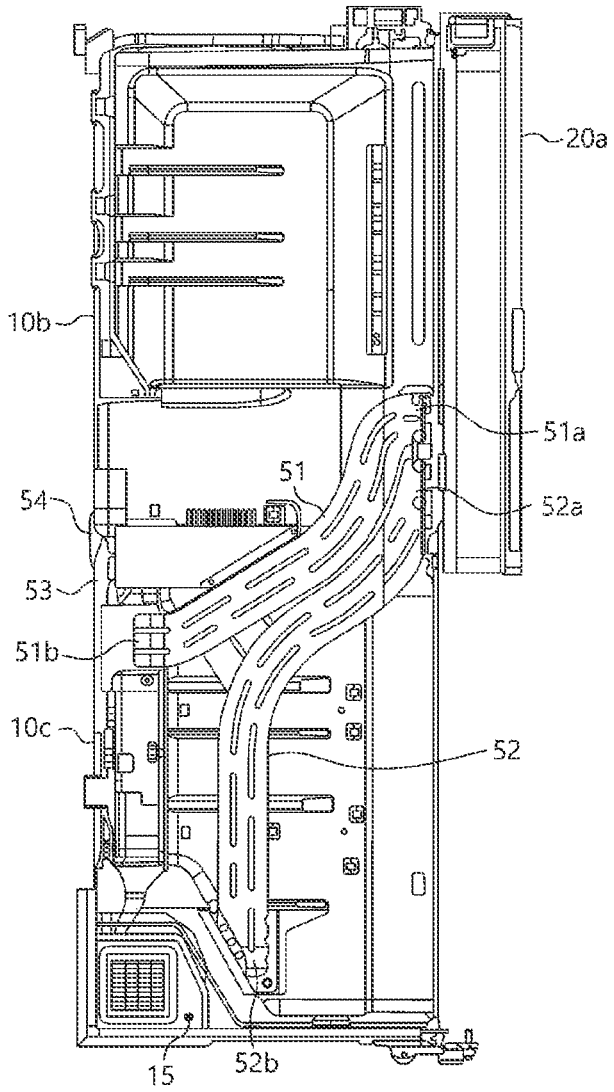

A first end 51*a* of the cool air duct 51 for the ice-making compartment is installed by penetrating any one side surface (a side where the refrigerating compartment door with the ice-making compartment is located, the right side in the drawing when viewed from the rear surface) of the freezing compartment side grille fan assembly 2. That is, an outlet from which the cool air of the cool air passage 213 for the ice-making compartment flows out is configured to be opened toward any one side portion between a grille panel 220 and a shroud 210 constituting the freezing compartment side grille fan assembly 2, so that the cool air blown by an ice-making fan 241 may flow smoothly without sudden change of direction. The above structure is as shown in FIGS. 8 and 11.

In addition, a second end 51*b* of the cool air duct 51 for the ice-making compartment is configured to penetrate a side wall of the inner casing 10*b* for the refrigerating compartment to be exposed into the refrigerating compartment 11.

The second end 51*b* of the cool air duct 51 for the ice-making compartment is configured to supply the cool air to a supply guide duct 21*a* while matching with the supply guide duct 21*a* provided in the first refrigerating compartment door 20*a* when the first refrigerating compartment door 20*a* having the ice-making compartment 21 is operated to be closed. The supply guide duct 21*a* is formed to be extended to the ice-making compartment 21 and configured to supply the cool air to the ice-making compartment 21.

Figure 12:
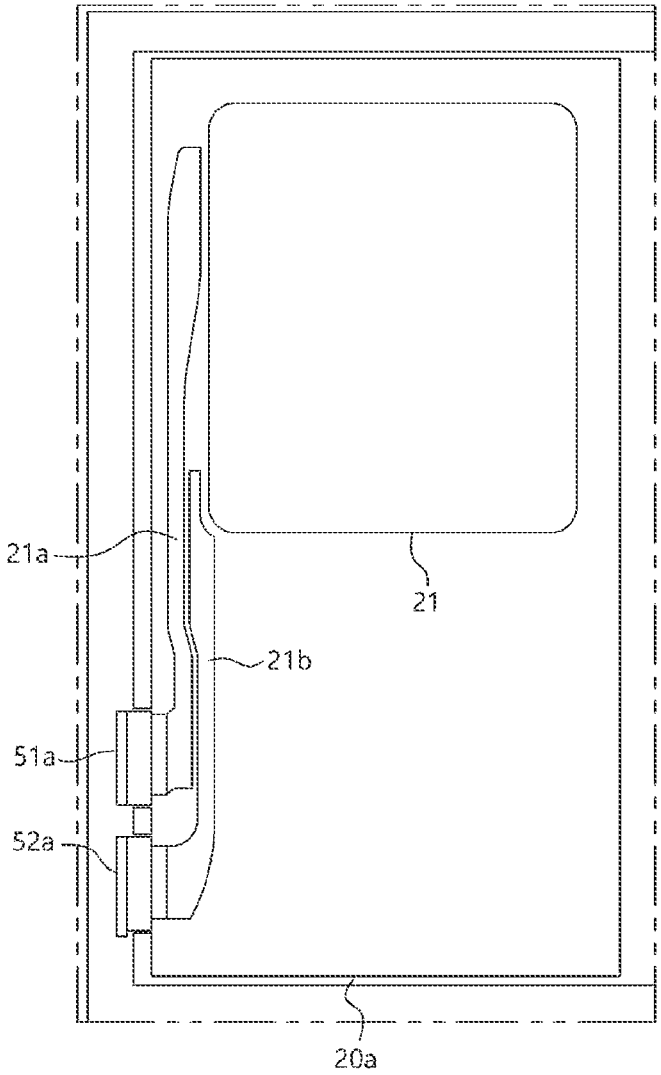
FIG. 12 is a state view schematically showing a passage structure for supply and recovery cool air to the ice-making compartment of the refrigerator according to the embodiment of the present disclosure.

In addition, a recovery guide duct 21*b* is provided in the first refrigerating compartment door 20*a*. A first end of the recovery guide duct 21*b* is connected to the ice-making compartment 21 and a second end thereof is formed to be extended to a lower portion of a side wall of the first refrigerating compartment door 20*a*, thereby guiding a recovery flow of the cool air passing through the ice-making compartment 21. The above structure is as shown in FIG. 12.

Further, a recovery duct 52 for the ice-making compartment is provided in a gap between the outer casing 10*a* and any one side wall of the inner casing 10*b*, 10*c* of the cabinet 10.

The recovery duct 52 for the ice-making compartment is a duct for guiding the cool air passing through the ice-making compartment 21 to be recovered to the freezing compartment 12.

Figure 9:
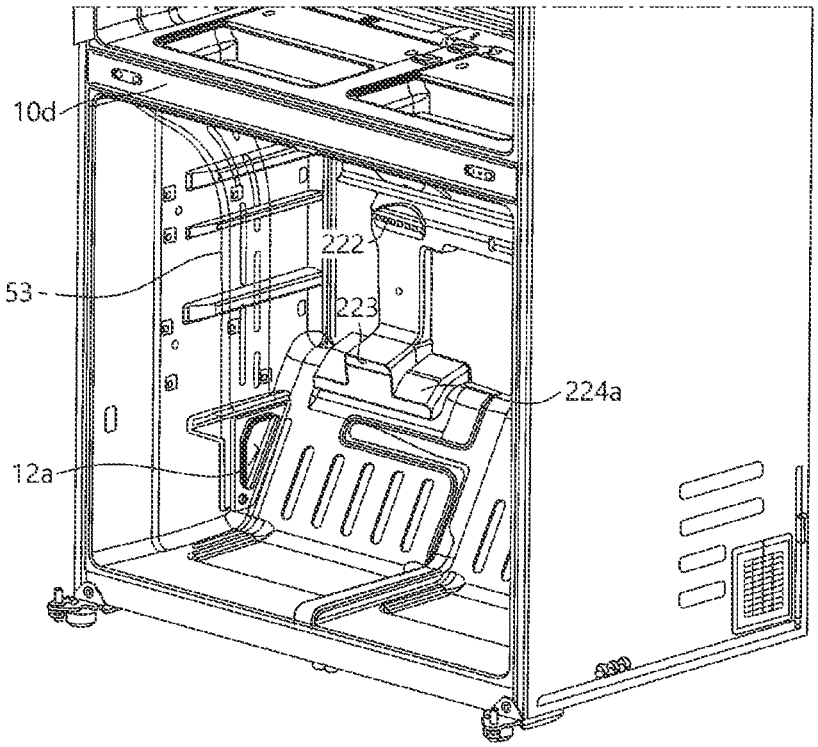
FIG. 9 is a main-part perspective view showing a state of either side wall surface in a freezing compartment for showing a connection structure of the recovery duct for the ice-making compartment of the refrigerator according to the embodiment of the present disclosure.

A first end 52*a* of the recovery duct 52 for the ice-making compartment is configured to penetrate the side wall of the inner casing 10*b* for the refrigerating compartment to be exposed into the refrigerating compartment 11. The first end 52*a* of the recovery duct 52 for the ice-making compartment is configured to match with the second end of the recovery guide duct 21*b* when the first refrigerating compartment door 20*a* having the ice-making compartment 21 is operated to be closed. The above structure is as shown in FIGS. 8, 9, and 11.

In addition, a second end 52*b* of the recovery duct 52 for the ice-making compartment is configured to pass through a penetration hole 12*a* (referring to FIGS. 5 and 9) provided in a side wall of the inner casing 10*c* for the freezing compartment to be exposed into the freezing compartment 12.

The second end 52*b* of the recovery duct 52 for the ice-making compartment is configured to be located at the rearmost side of the lower compartment in the freezing compartment 12.

In particular, it is preferable that the penetration hole 12*a* where the second end 52*b* of the recovery duct 52 for the ice-making compartment is located is located as close to a cool air suction side (a side where cool air recovered from the freezing compartment to the evaporator is suctioned) of the freezing compartment side grille fan assembly 2 as possible. That is, the cool air recovered from the recovery duct 52 for the ice-making compartment should flow directly toward the evaporator 40 without affecting the temperature and humidity in the freezing compartment 12 as little as possible.

In the embodiment of the present disclosure, the penetration hole 12*a*, in which the second end 52*b* of the recovery duct 52 for the ice-making compartment is located, is located in parallel with a side portion of a first suction guide 224*a* provided in the freezing compartment side grille fan assembly 2 of any one side wall of the inner casing 10*c* for the freezing compartment.

In particular, the second end 52*b* (or, the penetration hole 12*a* where the second end is located) of the recovery duct 52 for the ice-making compartment is formed in a triangular structure that gradually narrows toward a lower portion thereof, and the second end 52*b* being configured to be opened to the lower compartment in the freezing compartment 12.

That is, when a cool air discharge portion (or, the penetration hole) of the recovery duct 52 for the ice-making compartment is formed to have a long structure in the transverse direction, the temperature in the freezing compartment 12 may be affected by the structure. However, as shown in the embodiment of the present disclosure, the cool air discharge portion (or, penetration hole) of the triangular structure of the recovery duct 52 for the ice-making compartment has a vertically long structure while considering the shape of the machine room 15, so that the effect on the temperature in the freezing compartment 12 may be minimal.

Meanwhile, according to the embodiment of the present disclosure, the refrigerating compartment side grille fan assembly 1 of the refrigerator is configured to supply the cool air, which is provided from the freezing compartment side grille fan assembly 2 through the connection duct 54, to each portion in the refrigerating compartment 11. The freezing compartment side grille fan assembly 2 is configured to selectively supply the cool air, which is heat-exchanged by passing through the evaporator 40, to the refrigerating compartment 11, the freezing compartment 12, or the ice-making compartment 21.

Figure 10:
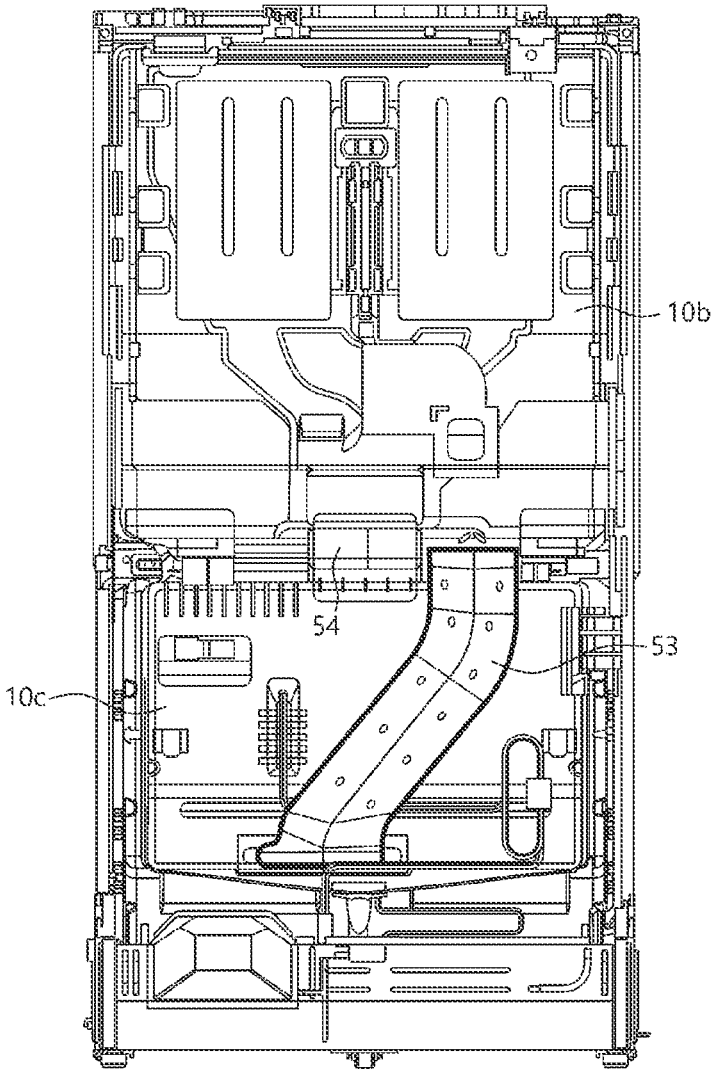
FIG. 10 is a rear view showing the refrigerator according to the embodiment of the present disclosure in a state in which the outer casing is removed for showing an installation structure of the connection duct and the recovery duct for the refrigerating compartment.

The connection duct 54 is configured to connect the center of a lower portion of the refrigerating compartment side grille fan assembly 1 to the center of an upper portion of the freezing compartment side grille fan assembly 2. The above structure is as shown in FIGS. 8 and 10.

The refrigerating compartment side grille fan assembly 1 is configured to supply the cool air, which is supplied from the connection duct 54, to each portion in the refrigerating compartment 11 through a cool air passage 121 for the refrigerating compartment. The refrigerating compartment side grille fan assembly 1 may have a plurality of cool air outlets 111, 112, and 113, so that the cool air flowing along the cool air passage 121 for the refrigerating compartment is discharged into the refrigerating compartment 11.

In addition, a passage opening and closing module 60 is provided in at least one portion of the refrigerating compartment side grille fan assembly 1 or the connection duct 54. The passage opening and closing module 60 is a configuration that is provided to selectively block the cool air of the cool air passage 214 for the freezing compartment introduced through the connection duct 54.

That is, by the passage opening and closing module 60, the selective cool air supply may be performed in the cool air passage 121 for the refrigerating compartment of the refrigerating compartment side grille fan assembly 1.

The passage opening and closing module 60 may be provided in a cool air inlet side of the cool air passage 121 for the refrigerating compartment.

That is, the refrigerating compartment side grille fan assembly 1 and the freezing compartment side grille fan assembly 2 are respectively formed in separate bodies and then are configured to communicate with each other through the connection duct 54. In particular, since the cool air passage 121 for the refrigerating compartment of the refrigerating compartment side grille fan assembly 1 does not have any special operating element, it is preferable to install the passage opening and closing module 60 in the refrigerating compartment side grille fan assembly 1 rather than in the connection duct 54 or the freezing compartment side grille fan assembly 2.

Figure 6:
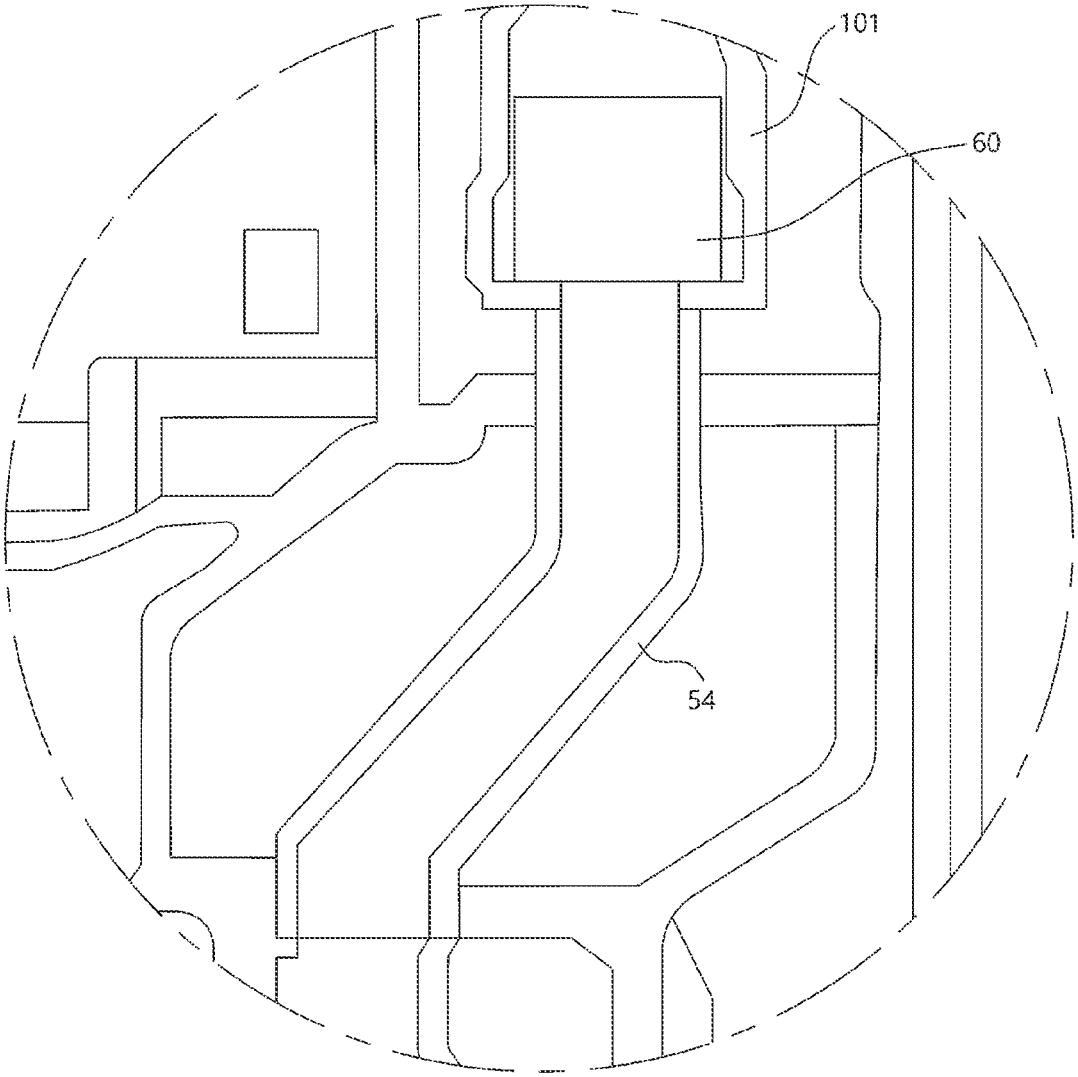
FIG. 6 is an enlarged view of part A in FIG. 5.
Figure 7:
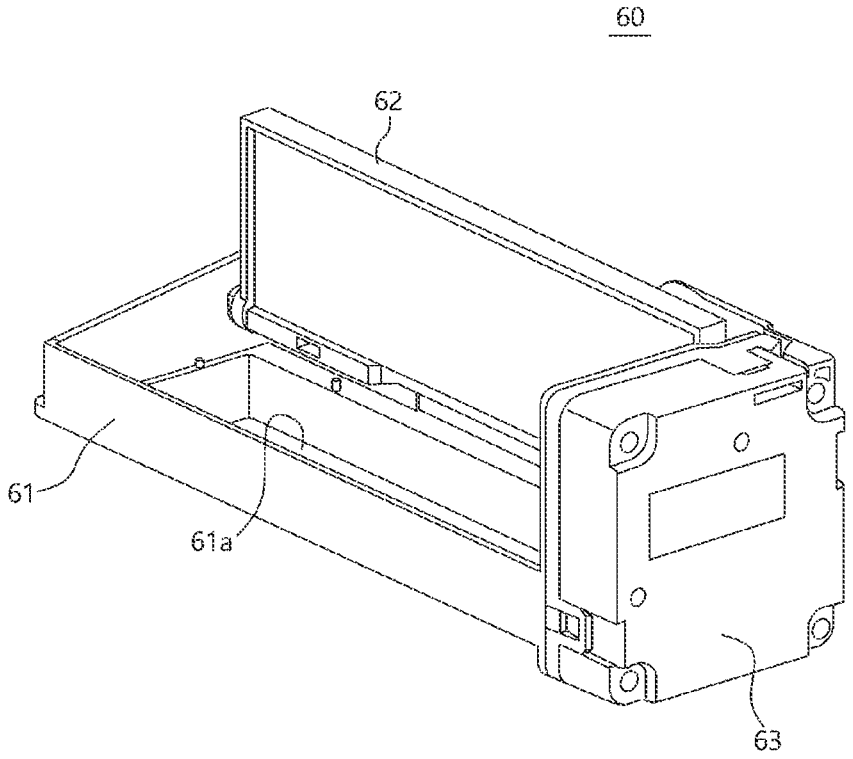
FIG. 7 is a perspective view showing an example of a passage opening and closing module of the refrigerator according to the embodiment of the present disclosure.

A mounting end 101 extended more than the connection duct 60 is provided in the cool air inlet side of the cool air passage 121 for the refrigerating compartment. The passage opening and closing module 60 is configured to be provided in the mounting end 101 and to selectively block the flow of the cold air passing through the mounting end 101. The above structure is as shown in FIGS. 5 and 6.

The passage opening and closing module 60 includes a damper casing 61, an opening and closing damper 62, and a damper operation part 63.

The damper casing 61 is configured to block the inside of the mounting end 101 and is formed in a rectangular frame structure in which a through hole 61*a* is provided. The opening and closing damper 62 is configured to be provided in the damper casing 61 and to open and close the through hole 61*a*. The damper operation part 63 is configured to operate the opening and closing damper 62.

The damper operation part 63 may be a motor, the opening and closing damper 62 may be formed in a plate that rotates while being coupled to the motor by a shaft to close or open the through hole 61*a*.

Although not shown in the drawings, the passage opening and closing module 60 may be configured to forcibly close or open a passage through which the cool air passes by a solenoid or cylinder, or may be configured in various structures other than that.

According to the embodiment of the present disclosure, the freezing compartment side grille fan assembly 2 has the two cool air passages 213 and 214 that guide the flow of the cool air by operations of the two fan modules 230 and 240.

That is, the freezing compartment side grille fan assembly 2 has the cool air passage 214 for the freezing compartment that guides the flow of cool air blown by a freezing fan 231 of a freezing fan module 230, and the freezing compartment side grille fan assembly 2 has the cool air passage 213 for the ice-making compartment that guides the flow of cool air blown by the ice-making fan 241 of an ice-making fan module 240.

In particular, the cool air passage 214 for the freezing compartment and the cool air passage 213 for the ice-making compartment share cool air with each other through the shared passage 215*a*, 215*b*. However, an open port ion of a cool air outlet side of the shared passage 215*a*. 215*b* is formed not to face the freezing fan module 230.

As described above, according to the embodiment of the present disclosure, by sharing cool air between the two cool air passages 213 and 214 by the shared passage 215*a*, 215*b*, the freezing compartment side grille fan assembly 2 of the refrigerator may supply more cool air to the freezing compartment 12. In addition, when only the ice-making fan 241 is operated, the cool air in the freezing compartment 12 may be prevented from flowing backward.

Hereinbelow, the embodiment with respect to a detailed structure of the freezing compartment side grille fan assembly 2 will be described in detail with reference to FIGS. 13 to 25.

The freezing compartment side grille fan assembly 2 includes the shroud 210.

The shroud 210 is a portion forming a rear wall surface of the freezing compartment side grille fan assembly 2.

The evaporator 40 is located in the rear of the freezing compartment 12 of a rear wall surface in the cabinet 10 (a rear wall surface in the inner casing). The shroud 210 is located at front of the evaporator 40.

Figure 19:
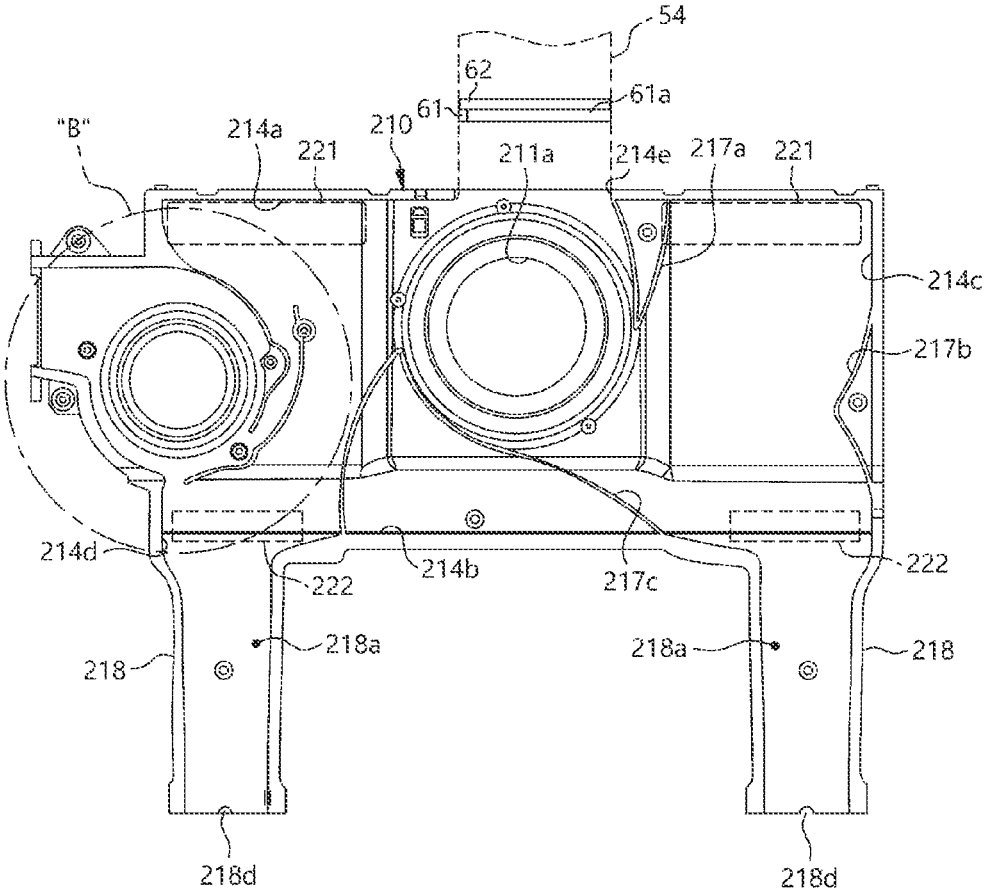
FIG. 19 is a front view showing the shroud of the freezing compartment side grille fan assembly of the refrigerator according to the embodiment of the present disclosure.
Figure 20:
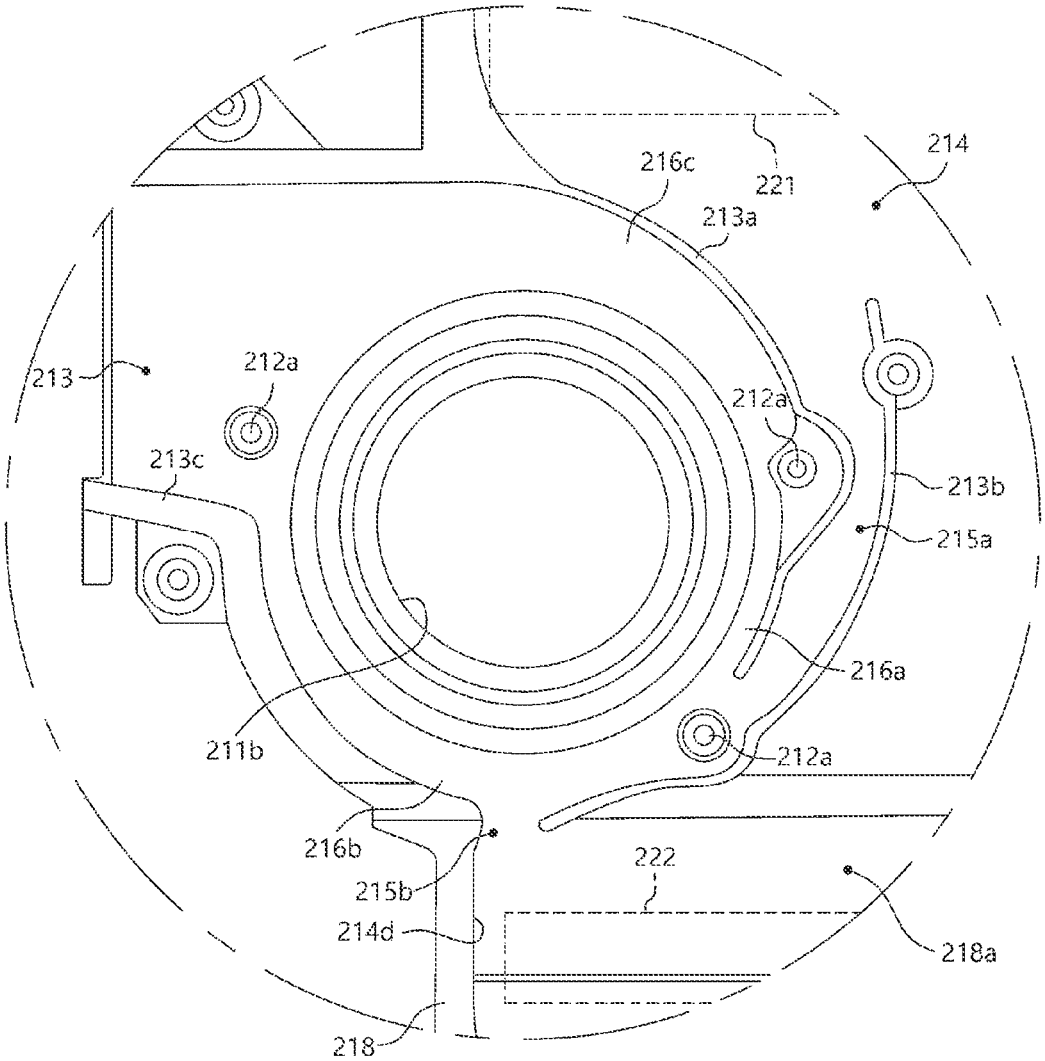
FIG. 20 is an enlarged view of part B in FIG. 19.
Figure 21:
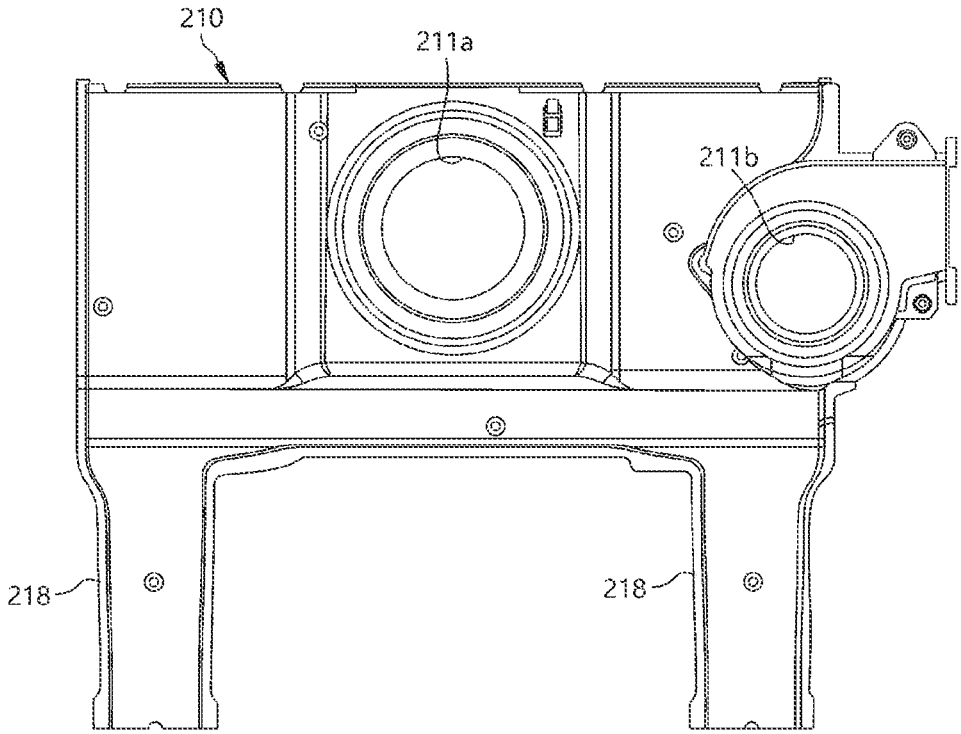
FIG. 21 is a rear view showing the shroud of the freezing compartment side grille fan assembly of the refrigerator according to the embodiment of the present disclosure.

FIG. 19 is a front view showing the shroud 210 of the freezing compartment side grille fan assembly 2 of the refrigerator according to the embodiment of the present disclosure. FIG. 20 is an enlarged view of part B in FIG. 19. FIG. 21 is a rear view showing the shroud 210 of the freezing compartment side grille fan assembly 2 of the refrigerator according to the embodiment of the present disclosure.

As shown in the drawings, the shroud 210 has a first inlet hole 211*a* and a second inlet hole 211*b* that are formed by penetrating the shroud 210.

The two inlet holes 211*a* and 211*b* are holes provided to allow the cool air, which is heat-exchanged while passing through the evaporator 40 located at the rear in the freezing compartment 12, to flow into a gap between the grille panel 220 for the freezing compartment and the shroud 210.

In a front surface of the shroud 210, the freezing fan module 230 is installed in a portion where the first inlet hole 211*a* is formed, and the ice-making fan module 240 is installed in a portion where the second inlet hole 211*b* is formed.

The freezing fan module 230 is located to face the first inlet hole 211*a*, and the ice-making fan module 240 is located to face the second inlet hole 211*b*.

In particular, the first inlet hole 211*a* is located at a center portion between the upper compartment and the middle compartment constituting the freezing compartment 12. The second inlet hole 211*b* is located at either side of the first inlet hole 211*a*. That is, the freezing fan module 230 is located at the center portion between the upper compartment and the middle compartment constituting the freezing compartment 12 in each portion of the freezing compartment side grille fan assembly 2, and the ice-making fan module 240 is located at either side of the freezing fan module 230. Therefore, the cool air blown in a radial direction of the freezing fan 231 by the operation of the freezing fan module 230 may be smoothly supplied to all of the upper, middle, and lower compartments in the freezing compartment 12. Further, the cool air blown in a radial direction of the ice-making fan 241 by the operation of the ice-making fan module 240 may be conveyed with a directionality toward the side of the freezing compartment side grille fan assembly 2.

The first inlet hole 211*a* is designed in consideration of the amount of cool air supplied to the freezing compartment 12 through the freezing fan module 230. The second inlet hole 211*b* is designed in consideration of the pressure of cool air supplied to the ice-making compartment 21 through the ice-making fan module 240.

That is, the freezing fan module 230 is configured to supply a sufficient amount of cool air, since the freezing fan module 230 supplies the cool air to the freezing compartment 12 located at front of the freezing fan module 230 and the refrigerating compartment 11 located directly above the freezing fan module 230. However, the ice-making fan module 240 supplies the cool air to the ice-making compartment 21 located in the first refrigerating compartment door 20*a*, so the ice-making fan module 240 should be configured to supply a sufficient amount of cool air over a long distance.

In addition, the cool air passage 213 for the ice-making compartment and the cool air passage 214 for the freezing compartment are respectively formed at the front surface of the shroud 210 (referring to FIGS. 19 and 20).

The cool air passage 213 for the ice-making compartment is a passage that guides the cool air passing through the second inlet hole 211*b* and flowing into a gap between the shroud 210 and the grille panel 220 to flow into a connection portion with the cool air duct 51 for the ice-making compartment. The cool air passage 214 for the freezing compartment is a passage that guides the cool air blown by the freezing fan 231 to each of the upper compartment, the middle compartment, and the lower compartment of the freezing compartment 12.

The cool air passage 214 for the freezing compartment is formed by recessing the front surface of the shroud 210. The cool air passage 213 for the ice-making compartment is formed in either side of the cool air passage 214 for the freezing compartment in the front surface of the shroud 210.

Outer edge portions of the front surface of the shroud 210 constitute inner wall surfaces of the cool air passage 214 for the freezing compartment. That is, the cool air passage 214 for the freezing compartment is formed to have an upper wall surface 214*a* located at the upper side on the basis of the first inlet hole 211*a*, a lower wall surface 214*b* located at the lower side on the basis of the first inlet hole 211*a*, a first side wall surface 214*c* at the side where the cool air passage 213 for the ice-making compartment is located, and a second side wall surface 214*d* facing the first side wall surface 214*c*.

In addition, the upper wall surface 214*a* has a cool air outlet 214*e*.

The cool air outlet 214*e* is an open portion to communicate with a part of the cool air passage 214 for the freezing compartment, the cool air outlet 214*e* being located at a directly upper portion of the freezing fan 231. The cool air outlet 214*e* is connected to a first end of the connection duct 54.

The cool air passage 214 for the freezing compartment and the cool air passage 213 for the ice-making compartment are formed to be separated from each other by passage rib 213*a*, 213*b* (shown in FIG. 20). That is, the cool air passage 213 for the ice-making compartment separated from the cool air passage 214 for the freezing compartment by the passage rib 213*a*. 213*b* is provided on the front surface of the shroud 210.

The passage rib 213*a*. 213*b* protrudes from the front surface of the shroud 210 and forms a circumferential wall surface of the cool air passage 213 for the ice-making compartment. That is, the cool air introduced through the second inlet hole 211*b* is guided to the connection portion with the cool air duct 51 for the ice-making compartment by flowing along the cool air passage 213 for the ice-making compartment formed by the passage rib 213*a*, 213*b*.

The passage rib 213*a*, 213*b* includes a first circumferential passage rib 213*a* and a second circumferential passage rib 213*b* that are formed along a circumference of the second inlet hole 211*b*.

The port ion where the second inlet hole 211*b* is provided may be partitioned from the cool air passage 214 for the freezing compartment by the two circumferential passage ribs 213*a* and 213*b*. The cool air passing through the second inlet hole 211*b* may be blown along the cool air passage 213 for the ice-making compartment formed by the passage rib 213*a*, 213*b* into the cool air duct 51 for the ice-making compartment.

The first circumferential passage rib 213*a* is configured to cross between the first inlet hole 211*a* and the second inlet hole 211*b* in the front surface of the shroud 210. That is, as the first circumferential passage rib 213*a* is configured to block between the ice-making fan module 240 and the freezing fan module 230, the cool air provided from the freezing fan module 230 is prevented from being directly discharged to a cool air outlet of the cool air passage 213 for the ice-making compartment.

In addition, the first circumferential passage rib 213*a* is rounded to surround a part of a circumference at one side (a side of the freezing fan module is located) of the ice-making fan module 240. Accordingly, the cool air blown in the radial direction of the ice-making fan 241 by the operation of the ice-making fan 241 may flow in a circumferential direction of the ice-making fan 241 by guidance of the first circumferential passage rib 213*a*, and may flow toward the communication portion with the cool air duct 51 for the ice-making compartment.

The second circumferential passage rib 213*b* is configured to surround a lower circumference of a portion where the ice-making fan module 240 is installed, in the front surface of the shroud 210. That is, the second circumferential passage rib 213*b* divides the lower portion of the ice-making fan module 240 from the center portion between the ice-making fan module 240 and the freezing fan module 230.

In addition, the second circumferential passage rib 213*b* is rounded to surround the lower circumference of the ice-making fan module 240.

The passage rib 213*a*. 213*b* has the shared passage 215*a*. 215*b*.

The shared passage 215*a*, 215*b* includes an upper shared passage 215*a*.

That is, the upper shared passage 215*a* allows the cool air in the cool air passage 213 for the ice-making compartment blown by the ice-making fan module 240 to be partially supplied into the cool air passage 214 for the freezing compartment.

In particular, when the freezing fan 231 and the ice-making fan 241 are operated at the same time, the upper shared passage 215*a* is configured such that part of the cool air blown by the ice-making fan 241 is additionally supplied into the freezing compartment 12 through the upper shared passage 215*a*. Accordingly, the amount of cool air supplied to the freezing compartment 12, whereby it is possible to quickly control the temperature in the freezing compartment 12.

When the freezing fan 231 is not operated and only the ice-making fan 241 is operated, the pressure at the side of the second inlet hole 211*b* where the ice-making fan 241 is located is relatively lower than the pressure at the side of the first inlet hole 211*a*. Therefore, there is concern that the cool air in the freezing compartment 12 passes through the cool air passage 214 for the freezing compartment and flows through the first inlet hole 211*a* into the portion where the evaporator 40 is located, and then the cool air is suctioned through the second inlet hole 211*b* into the cool air passage 213 for the ice-making compartment.

However, by the provision of the upper shared passage 215*a*, even when only the ice-making fan 241 is operated, the pressure difference between the two passages 213 and 214 is reduced by sharing the cool air between the cool air passage 214 for the freezing compartment and the cool air passage 213 for the ice-making compartment. Accordingly, the cool air in the freezing compartment 12 is prevented from flowing back into the cool air passage 213 for the ice-making compartment.

In addition, the first circumferential passage rib 213*a* is formed to be spaced apart from the second circumferential passage rib 213*b*. That is, as the first circumferential passage rib 213*a* and the second circumferential passage rib 213*b* are spaced apart from each other, the upper shared passage 215*a* through which the cool air flows is provided.

Figure 16:
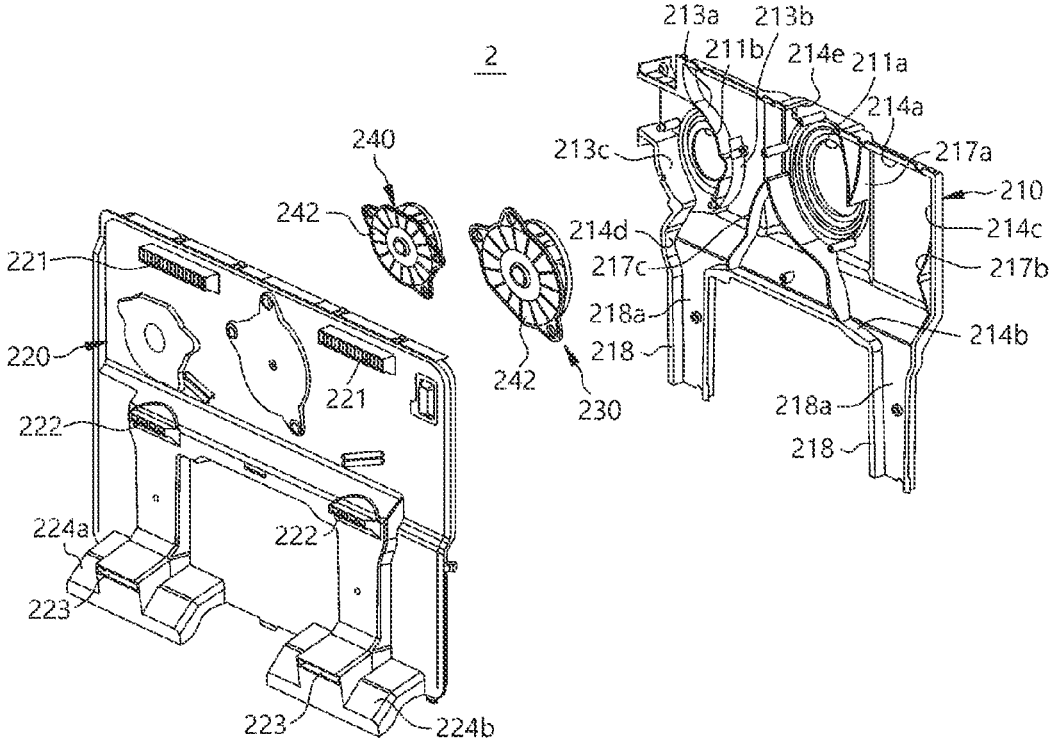
FIG. 16 is an exploded-perspective view from a front side of the refrigerator, the view showing the freezing compartment side grille fan assembly of the refrigerator according to the embodiment of the present disclosure.

In particular, an upper end of the second circumferential passage rib 213*b* is formed to surround an outer circumferential surface of a lower end of the first circumferential passage rib 213*a*. That is, the structure of the two circumferential passage ribs 213*a* and 213*b* forms the upper shared passage 215*a* to face an upper surface of either side (the upper surface of the side where the cool air passage for the ice-making compartment is provided, the side where a cool air outlet for the upper compartment is provided) in the cool air passage 214 for the freezing compartment. The above structure is as shown in FIG. 16.

A cool air outlet 221 for the upper compartment is located in a portion facing the upper shared passage 215*a*. Through cool air outlet 221 for the upper compartment, part of the cool air flowing in the cool air passage 213 for the ice-making compartment is supplied to an upper portion of the cool air passage 214 for the freezing compartment, and then may be supplied through the cool air outlet 221 for the upper compartment to the upper compartment of the freezing compartment 12.

That is, even when the cool air passing through the upper shared passage 215*a* is supplied into the cool air passage 214 for the freezing compartment, the cool air is directly discharged to the freezing compartment 12 through the cool air outlet 221 for the upper compartment, so that the flow of the cool air flowing in the cool air passage 214 for the freezing compartment is not affected.

In particular, the open portion at the cool air outlet side of the upper shared passage 215*a* is formed not to face the freezing fan module 230 located in the first inlet hole 211*a*.

That is, the discharge direction of the cool air provided from the upper shared passage 215*a* and the direction of the cool air blown by the freezing fan module 230 are configured not to coincide with each other, thereby preventing flow interference between two cool air flows.

Figure 15:
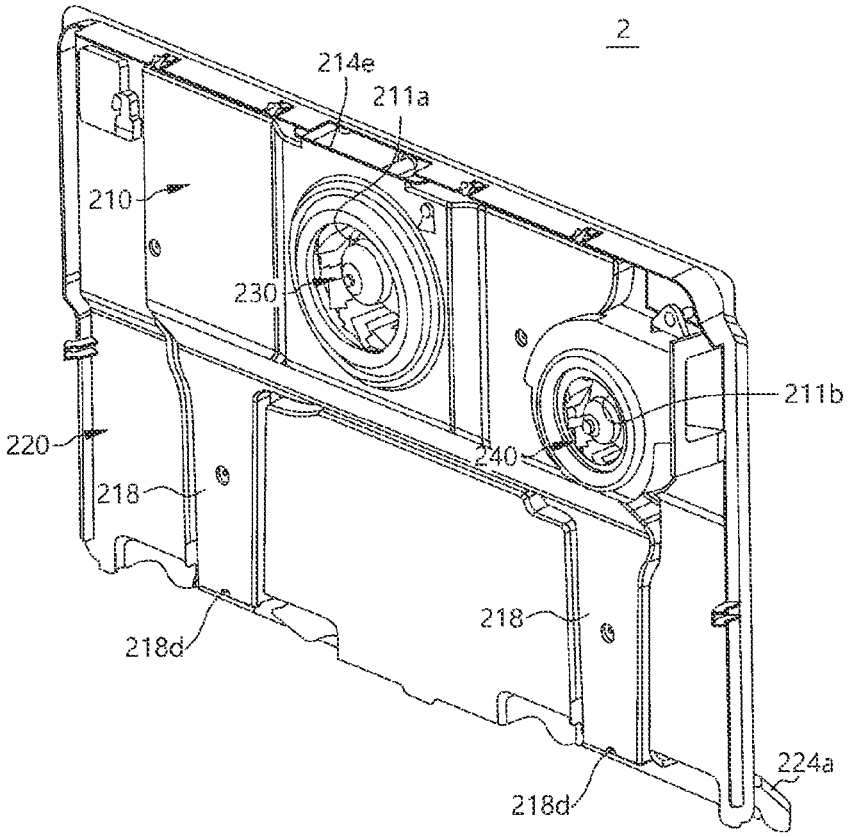
FIG. 15 is a perspective view showing the freezing compartment side grille fan assembly of the refrigerator according to the embodiment of the present disclosure.

Therefore, the upper end of the second circumferential passage rib 213*b* is configured to be located higher than the first inlet hole 211*a* (referring to FIG. 15). That is, the cool air flowing in the circumferential direction of the freezing fan 231 by the rotation of the freezing fan 231 is prevented from being directly blowing toward the open portion at the cool air outlet side of the upper shared passage 215*a*.

However, when the upper end of the second circumferential passage rib 213*b* is located lower than the first inlet hole 211*a*, while the cool air blowing from the freezing fan 231 is provided into the upper shared passage 215*a* between the first circumferential passage rib 213*a* and the second circumferential passage rib 213*b*, interference between the cool air blowing from the freezing fan 231 and the cool air discharged from the upper shared passage 215*a* may occur. Therefore, the upper end of the second circumferential passage rib 213*b* is configured to be located higher than the first inlet hole 211*a*, so that collision between the cool air discharged from the upper shared passage 215*a* and the cool air blown by the freezing fan 231 may be prevented (or minimized).

In addition, the upper end of the second circumferential passage rib 213*b* is configured to be gradually spaced apart from the lower end of the first circumferential passage rib 213*a* the second circumferential passage rib 213*b* goes upward.

That is, the upper shared passage 215*a* is configured to be gradually increased as the upper shared passage 215*a* goes from a cool air inlet side (a side communicating with the cool air passage for the ice-making compartment) to the cool air outlet side (a side communicating with the cool air passage for the freezing compartment).

Accordingly, the discharge flow rate of the cool air supplied to the cool air passage 214 for the freezing compartment through the upper shared passage 215*a* may be reduced, so that the flow of the cool air flowing along the cool air passage 214 for the freezing compartment by the operation of the freezing fan module 230 is not impeded (or the interference between the two air flows is minimized).

In addition, the shroud 210 may have a third circumferential passage rib 213*c*.

The third circumferential passage rib 213*c* is formed from a lower end of the second circumferential passage rib 213*b* (an end opposite to the side where the first circumferential passage rib is located) and penetrates the first side wall surface 214*c* of the shroud 210 to protrude outward.

That is, the cool air passage 213 for the ice-making compartment has a predetermined length passage by the third circumferential passage rib 213*c* and the protruding structure thereof. Accordingly, the cool air flowing in the circumferential direction along the two circumferential passage ribs 213*a* and 213*b* may be conveyed with the straightness toward the cool air duct 51 for the ice-making compartment connected to the freezing compartment side grille fan assembly 2.

The third circumferential passage rib 213*c* may be formed by bending (recessing or protruding) an edge portion of the shroud 210. The third circumferential passage rib 213*c* may be formed in a rib protruding from a surface of the shroud 210, as described above, the two circumferential passage ribs 213*a* and 213*b*.

In addition, the shroud 210 has an extension part 218.

The extension part 218 is a portion that is extended downward from a lower surface of each of opposite sides of the shroud 210 to the lower compartment of the freezing compartment 12.

In particular, an extension passage 218*a* communicating with the cool air passage 214 for the freezing compartment is provided at a front surface of the extension part 218, so that the part of the cool air flowing in the cool air passage 214 for the freezing compartment is guided to the portion where the lower compartment of the freezing compartment 12 is located.

The extension passage 218*a* (or the extension part) is formed to be extended downward from each of two facing portions of a cool air outlet 222 for the middle compartment in the cool air passage 214 for the freezing compartment to each of two facing portions of a cool air outlet 223 for the lower compartment.

That is, the cool air passage 214 for the freezing compartment formed in the shroud 210 guides the supply of cool air with respect to the upper and middle compartments of the freezing compartment 12. The extension passage 218*a* guides part of the cool air flowing in the cool air passage 214 for the freezing compartment to be supplied to the lower compartment of the freezing compartment 12.

Further, the shared passage 215*a*. 215*b* formed in the shroud 210 may include a lower shared passage 215*b*.

The lower shared passage 215*b* is a passage provided to guide the supply of the cool air to a lower surface side in the cool air passage 214 for the freezing compartment. When only the ice-making fan 241 is operated, the lower shared passage 215*b* supplies the cool air to the freezing compartment 12 to solve the pressure difference between the cool air passage 214 for the freezing compartment (or freezing compartment) and the cool air passage 213 for the ice-making compartment.

The lower shared passage 215*b* may be formed by spacing the lower end of the second circumferential passage rib 213*b* apart from a side wall surface 214*c* at the side where the cool air passage 213 for the ice-making compartment is provided, in the opposite side wall surfaces 214*c* and 214*d* of the cool air passage 214 for the freezing compartment.

That is, as the lower shared passage 215*b* is formed on a wall surface in the extension passage 218*a*, when the cool air is supplied into the cool air passage 214 for the freezing compartment 214 (or the extension passage) by passing through the lower shared passage 215*b*, the cool air may affect the cool air flowing from the cool air passage 214 for the freezing compartment to the extension passage 218*a*.

In particular, the lower end 213*d* (referring to FIG. 16) of the second circumferential passage rib 213*b* is formed by being bent in a direction parallel to a direction of the first side wall surface 214*c* at the side where the cool air passage 213 for the ice-making compartment is provided, in the opposite side wall surfaces of the cool air passage 214 for the freezing compartment. That is, as the lower shared passage 215*b* is formed to have a predetermined length, the cool air passing through the lower shared passage 215*b* may flow along wall surfaces of the first side wall surface 214*c* and the extension passage 218*a*.

The lower end 213*d* of the second circumferential passage rib 213*b* may be formed parallel to the first side wall surface 214*c*. Alternately, as the second circumferential passage rib 213*b* goes downward, the lower end 213*d* of the second circumferential passage rib 213*b* may be formed to be gradually adjacent toward the first side wall surface 214*c*.

Although not shown in the drawings, the lower shared passage 215*b* may be formed in a separate passage penetrating the second circumferential passage rib 213*b*.

In addition, a drainage hole 218*d* is formed by penetrating a lower end of the extension part 218.

That is, the inside of the cool air passage 213 for the ice-making compartment is configured to communicate with the refrigerating compartment 11 through the cool air duct 51 for the ice-making compartment. Because of the above structure, condensed water may be generated in the cool air duct 51 for the ice-making compartment due to the temperature difference with the outside air, and the condensed water may flow back to the cool air passage 213 for the ice-making compartment while flowing along the cool air duct 51 for the ice-making compartment.

Considering the above structure, the refrigerator is configured such that, the condensed water flowing back to the cool air passage 213 for the ice-making compartment flows down into the extension passage 218*a* through the lower shared passage 215*b* provided in the second circumferential passage rib 213*b*, and then the condensed water is discharged to the outside of the freezing compartment side grille fan assembly 2 through the drainage hole 218*d*.

Meanwhile, a cool air inlet side portion (a circumferential portion of the first inlet hole) of the cool air passage 213 for the ice-making compartment may be divided into a plurality of areas 216*a*, 216*b*, and 216*c* for inflow of cool air (referring to FIG. 20).

That is, the cool air passage 213 for the ice-making compartment is configured as three areas as follow. A first area 216*a* is commonly located between the first circumferential passage rib 213*a* and the ice-making fan module 240 and between the second circumferential passage rib 213*b* and the ice-making fan module 240. A second area 216*b* is located between a lower surface of the ice-making fan module 240 and the second circumferential passage rib 213*b*. A third area 216*c* is located between an upper surface of the ice-making fan module 240 and the first circumferential passage rib 213*a* and communicates with a cool air outlet side portion of the cool air passage 213 for the ice-making compartment.

In particular, the first area 216*a* communicates with the upper shared passage 215*a*, the second area 216*b* communicates with the lower shared passage 215*b*, and the third area 216*c* communicates with the cool air outlet side of the cool air passage 213 for the ice-making compartment.

In addition, the third area 216*c* is configured to supply the amount of cool air that is approximately equal to the sum of the supply amounts of cool air of the first area 216*a* and the second area 216*b*. The second area 216*b* is configured to supply a relatively larger amount of cool air than the first area 216*a*. That is, approximately half of the entire cool air blown by the operation of the ice-making fan 241 is supplied to the ice-making compartment 21 through the third area 216*c*, and the other half is supplied to the cool air passage 214 for the freezing compartment through the first area 216*a* and the second area 216*b*.

The cool air supplied to the first area 216*a* is discharged toward an upper space in the cool air passage 214 for the freezing compartment through the upper shared passage 215*a*. The cool air supplied to the second area 216*b* is discharged toward the lower space (the extension passage) in the cool air passage 214 for the freezing compartment through the lower shared passage 215*b*.

In addition, each of the above-described passage ribs 213*a*, 213*b*, and 213*c* are in close contact with a rear surface the grille panel 220, which will be described below, thereby closing the cool air passage 213 for the ice-making compartment formed by the passage ribs 213*a*, 213*b*, and 213*c* from the external environment of the freezing compartment side grille fan assembly 2.

Although now shown in the drawings, the cool air passage 213 for the ice-making compartment may be formed by protruding from the rear surface of the grille panel 220 toward the front surface of the shroud 210.

Further, a plurality of guides 217*a*, 217*b*, and 217*c* is formed on the front surface of the shroud 210.

That is, on the front surface of the shroud 210, the cool air passage 213 for the ice-making compartment and the cool air passage 214 for the freezing compartment are separately formed by the passage ribs 213*a*. 213*b*, and 213*c*. The cool air passage 214 for the freezing compartment is configured to uniformly or selectively supply the cool air to each port ion of the shroud 210 (or the grille fan) by the guides 217*a*, 217*b*, and 217*c*.

The guides 217*a*, 217*b*, and 217*c* may include a first guide 217*a* guiding an upper flow of the cool air that passes through the first inlet hole 211*a* of the shroud 210 and flows into the cool air passage 214 for the freezing compartment.

That is, when the cool air blown by the rotation of the freezing fan 231 in an upper direction of the freezing fan 231 hits the upper wall surface 214*a* of the cool air passage 214 for the freezing compartment, turbulence of the air flow occurs in the hit portion and the flow of the cool air is not smoothly performed. Considering the above problem, the first guide 217*a* is provided so that the cool air blown toward the upper wall surface 214*a* of the cool air passage 214 for the freezing compartment may flow toward the cool air outlet 214*e* formed on the upper wall surface 214*a*.

The first guide 217*a* may be formed in an inclined or rounded inverted triangular structure that is gradually expanded to opposite sides thereof, as the first guide 217*a* goes upward from a portion adjacent to the first inlet hole 211*a* to the upper wall surface 214*a* of the cool air passage 214 for the freezing compartment.

A lower end (lower vertex portion) of the first guide 217*a* is located on one side (a side opposite to the side where the cool air passage for the ice-making compartment is located) of the first inlet hole 211*a*. Therefore, more cool air that is rotatably blown in the circumferential direction of the freezing fan 231 may be supplied to a portion connected to the second end 52*b* of the recovery duct 52 for the ice-making compartment, in the opposite side spaces in the freezing compartment 12.

Further, the guides 217*a*. 217*b*, and 217*c* may include a second guide 217*b* that guides a lower flow of the cool air flowing into the space between the grille panel 220 and the shroud 210 by passing through the first inlet hole 211*a* of the shroud 210.

That is, when the cool air blown by the rotation of the freezing fan 231 in a lower direction of the freezing fan 231 hits the lower wall surface 214*b* of the cool air passage 214 for the freezing compartment, turbulence of the air flow occurs in the hit portion and the flow of the cool air is not smoothly performed. Considering the above problem, the second guide 217*b* is provided so that the cool air blown toward the lower wall surface 214*b* of the cool air passage 214 for the freezing compartment may flow smoothly toward the opposite sides of the lower wall surface 214*b*.

The second guide 217*b* may be formed in an inclined or rounded triangular structure that is gradually expanded to opposite sides thereof, as the second guide 217*b* goes downward from a portion adjacent to the first inlet hole 211*a* to the lower wall surface 214*b* of the cool air passage 214 for the freezing compartment.

An upper end (an upper vertex portion) of the second guide 217*b* is located on another side (the side where the cool air passage for the ice-making compartment is located) of the first inlet hole 211*a*.

In particular, the lower vertex portion of the first guide 217*a* and the upper vertex portion of the second guide 217*b* may be located symmetrically with each other around the center of the first inlet hole 211*a*. Therefore, half of the cool air blown while rotating in the circumferential direction of the freezing fan 231 may be supplied to one side space (the right side space of the partition wall when viewed from the front) in the freezing compartment 12, and another half may be supplied to another side space (the left side space of the partition wall when viewed from the front) in the freezing compartment 12 and to the refrigerating compartment 11.

Further, the guides 217*a*, 217*b*, and 217*c* may include a third guide 217*c* that guides upper and lower flows of the cool air flowing into the space between the grille panel 220 and the shroud 210 by passing through the first inlet hole 211*a* of the shroud 210.

That is, when the cool air blown toward the second side wall surface 214*d* of the cool air passage 214 for the freezing compartment by the rotation of the freezing fan 231 hits the second side wall surface 214*d* of the cool air passage 214 for the freezing compartment, turbulence of air flow occurs in the hit portion and the flow of the cool air is not smoothly performed. Considering the above problem, the third guide 217*c* is provided so that the cool air blown toward the second side wall surface 214*d* of the cool air passage 214 for the freezing compartment may flow smoothly toward the upper and lower sides of the second side wall surface 214*d*.

The third guide 217*c* may be formed in an inclined or rounded triangular structure that is gradually expanded upward and downward, as the third guide 217*c* goes from the side portion (the portion opposite to the side where the ice-making fan is located) of the first inlet hole 211*a* to the second side wall surface 214*d* of the cool air passage 214 for the freezing compartment.

The freezing compartment side grille fan assembly 2 includes the grille panel 220.

The grille panel 220 constitutes a front wall surface of the freezing compartment side grille fan assembly 2, and is located in front of the shroud 210.

Further, the grille panel 220 has a plurality of cool air outlets 221, 222, and 223.

Figure 22:
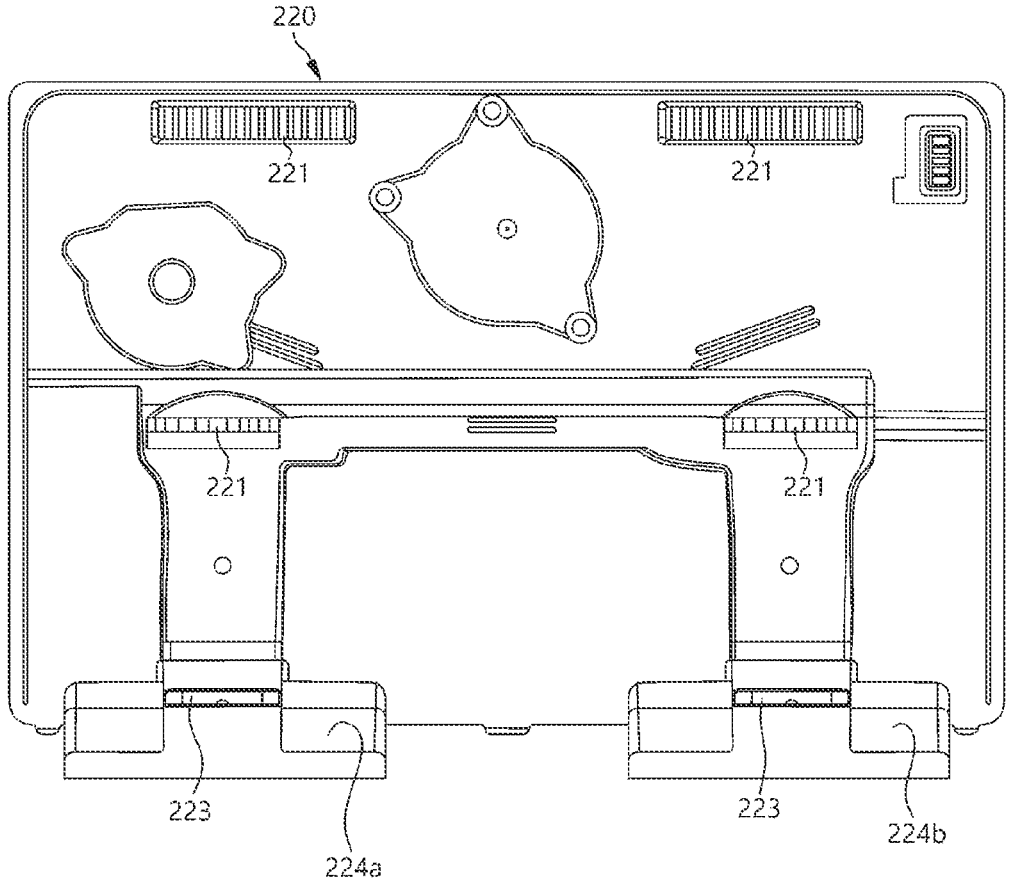
FIG. 22 is a front view showing a grille panel of the freezing compartment side grille fan assembly of the refrigerator according to the embodiment of the present disclosure.
Figure 23:
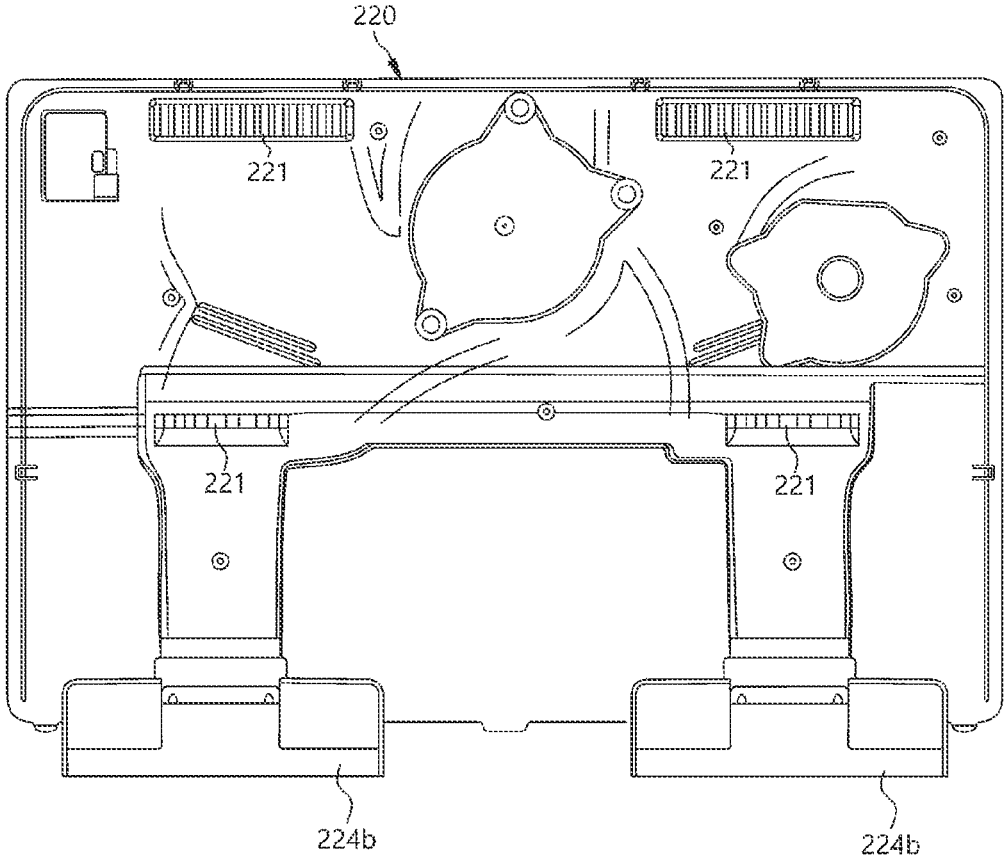
FIG. 23 is a rear view showing the grille panel of the freezing compartment side grille fan assembly of the refrigerator according to the embodiment of the present disclosure.
Figure 24:
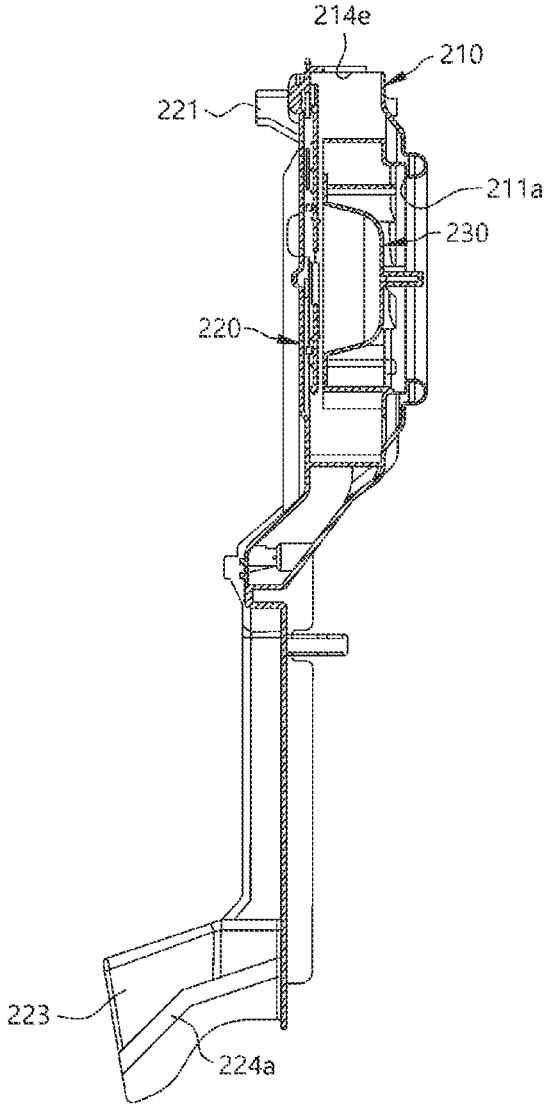
FIG. 24 is a section view taken along line I-I in FIG. 18.
Figure 25:
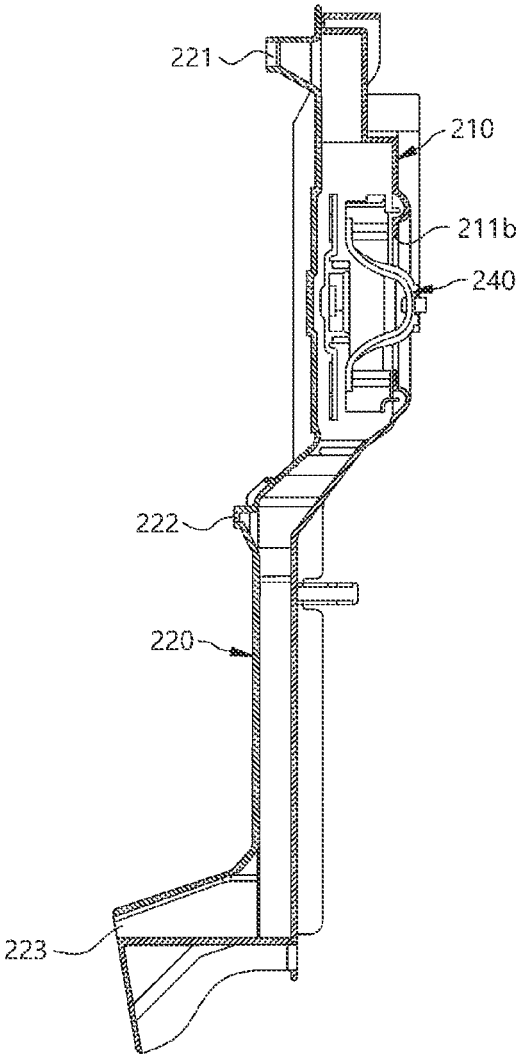
FIG. 25 is a section view taken along line II-II in FIG. 18.

The cool air outlets 221, 222, and 223 includes the cool air outlet 221 for the upper compartment discharging the cool air to the upper compartment of the freezing compartment 12, the cool air outlet 222 for the middle compartment discharging the cool air to the middle compartment of the freezing compartment 12, and the cool air outlet 223 for the lower compartment discharging the cool air to the lower compartment of the freezing compartment 12. The cool air outlets are as shown in FIGS. 22 to 24.

The cool air outlet 221 for the upper compartment is configured as two cool air outlets that are respectively formed at opposite upper sides of the portion where the freezing fan 231 is located. The cool air out let 222 for the middle compartment is configured as two cool air outlets that are respectively formed at opposite lower sides of the portion where the freezing fan 231 is located. The cool air outlet 223 for the lower compartment is configured as two cool air outlets that are respectively formed below the two cool air outlets 222 for the middle compartment.

In addition, the cool air out let 221 for the upper compartment and the cool air outlet 222 for the middle compartment are formed in tube bodies protruding into the freezing compartment 12.

Further, the cool air outlet 221 for the upper compartment and the cool air outlet 222 for the middle compartment have a plurality of grilles 221*a* and 222*a* guiding the discharge direction of the cool air.

Further, the grille panel 220 has suction guides 224*a* and 224*b* guiding the recovery flow of the cool air flowing through the freezing compartment 12. The suction guides 224*a* and 224*b* are provided in lower ends of the grille panel 220 and are configured to allow the cool air recovered after circulating in the freezing compartment 12 to flow into a lower end of the evaporator 40.

Each of the suction guides 224*a* and 224*b* is formed to be inclined (or rounded) at an angle the same (or similar) to a wall constituting the rear side bottom of the freezing compartment 12, as the suction guide goes to the lower end thereof. That is, the cool air flowing along a lower surface of the freezing compartment 12 may be guided by the suction guides 224*a* and 224*b* to smoothly flow to the lower end of the evaporator 40.

In particular, the suction guides 224*a* and 224*b* includes the first suction guide 224*a*, which is provided in one side in the lower ends of the grille panel 220 on the basis of the center portion of the grille panel 220, the side where the second end 52*b* of the recovery duct 52 for the ice-making compartment is located. The suction guides 224*a* and 224*b* includes a second suction guide 224*b*, which is provided another side in the lower ends of the grille panel 220 on the basis of the center portion of the grille panel 220, the side opposite to the first suction guide 224*a*. That is, cool air flowing through one space (a space communicating with the second end of the recovery duct for the ice-making compartment) in the freezing compartment 12 is recovered through the first suction guide 224*a*, and cool air flowing through another space in the freezing compartment 12 is recovered through the second suction guide 224*b*.

The freezing compartment side grille fan assembly 2 includes the freezing fan module 230.

The freezing fan module 230 is a configuration that blows cool air passing through the evaporator 40 to the cool air passage 214 for the freezing compartment.

The freezing fan module 230 is located in the first inlet hole 211*a*.

Figure 17:
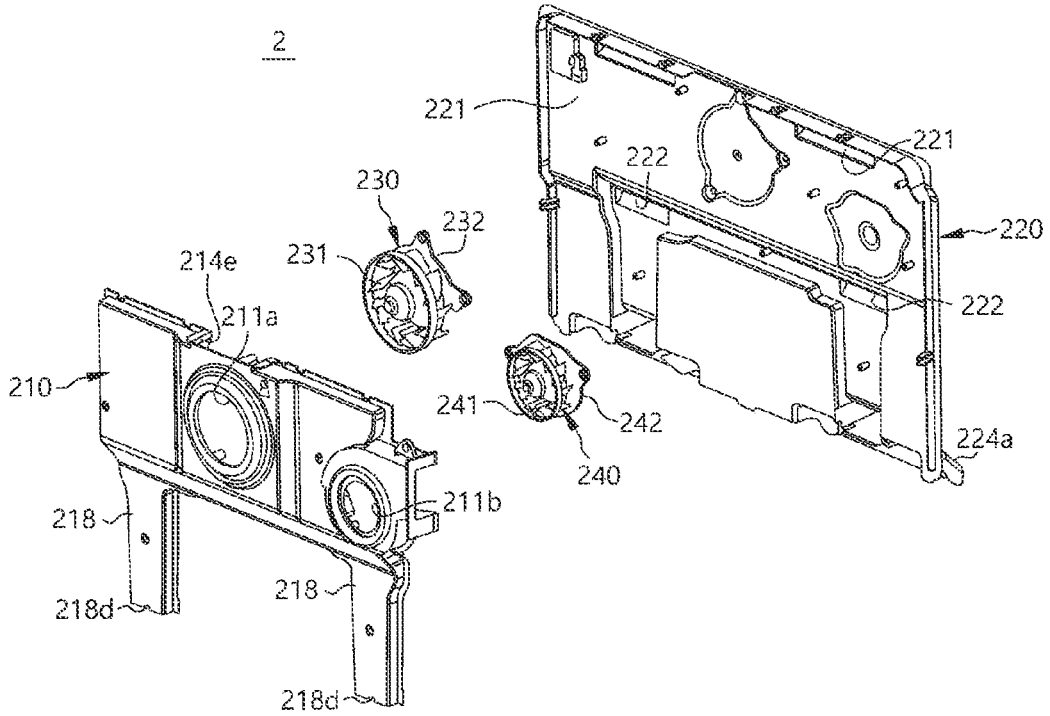
FIG. 17 is an exploded-perspective view from a rear side of the refrigerator, the view showing the freezing compartment side grille fan assembly of the refrigerator according to the embodiment of the present disclosure.

As shown in FIGS. 16 and 17, the freezing fan module 230 includes the freezing fan 231 and a first installation frame 232.

The freezing fan 231 may be formed in a slim centrifugal fan, so that the thickness (width in the front to rear direct ion) of the freezing compartment side grille fan assembly 2 may be reduced.

Further, the first installation frame 232 is a portion where the freezing fan 231 is installed.

The first installation frame 232 is configured to be coupled to a plurality of fastening ribs 212*a* formed in the shroud 210. The fastening ribs 212*a* may be respectively formed at positions considering the size and wind direction of the freezing fan 231.

The freezing compartment side grille fan assembly 2 includes the ice-making fan module 240.

The ice-making fan module 240 is a configuration that blows the cool air passing through the evaporator 40 to the cool air passage 213 for the ice-making compartment.

As shown in FIGS. 16 and 17, the ice-making fan module 240 includes a blowing fan 241 (Hereinbelow, the fan refers to "the ice-making fan") and a second installation frame 242.

The ice-making fan 241 may be formed in a slim centrifugal fan, so that the thickness (width in the front to rear direction) of the freezing compartment side grille fan assembly 2 may be reduced.

Further, the second installation frame 242 is a portion where the ice-making fan 241 is installed.

The second installation frame 242 is configured to be coupled to the plurality of the fastening ribs 212*a* formed in the shroud 210. The fastening ribs 212*a* may be respectively formed at the positions considering the size and wind direction of the ice-making fan 241.

Figure 13:
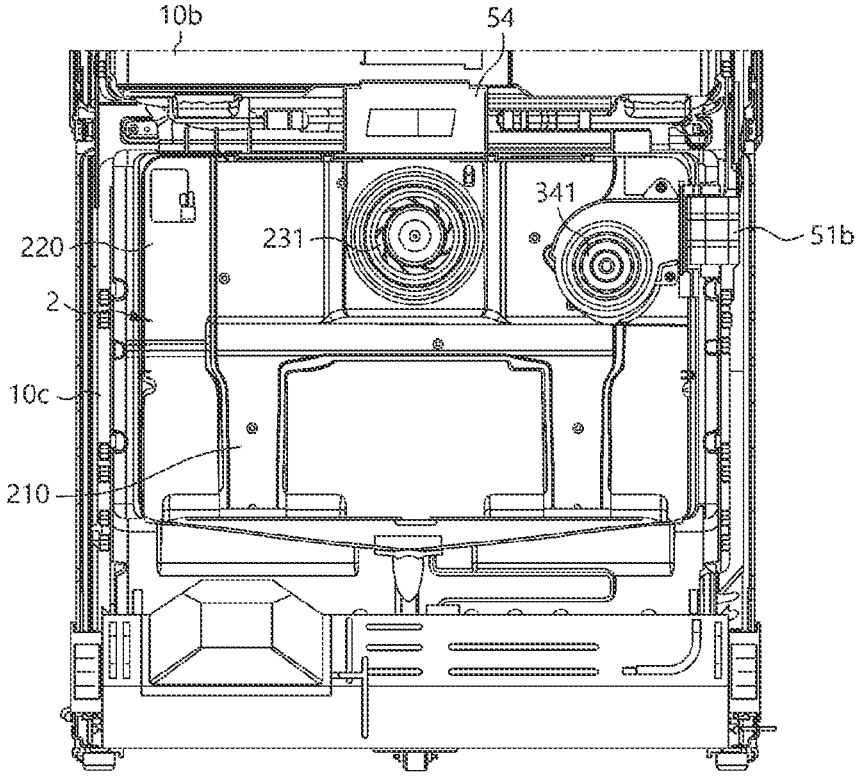
FIG. 13 is a front view showing an inside state of the freezing compartment for showing a freezing compartment side grille fan assembly of the refrigerator according to the embodiment of the present disclosure.
Figure 14:
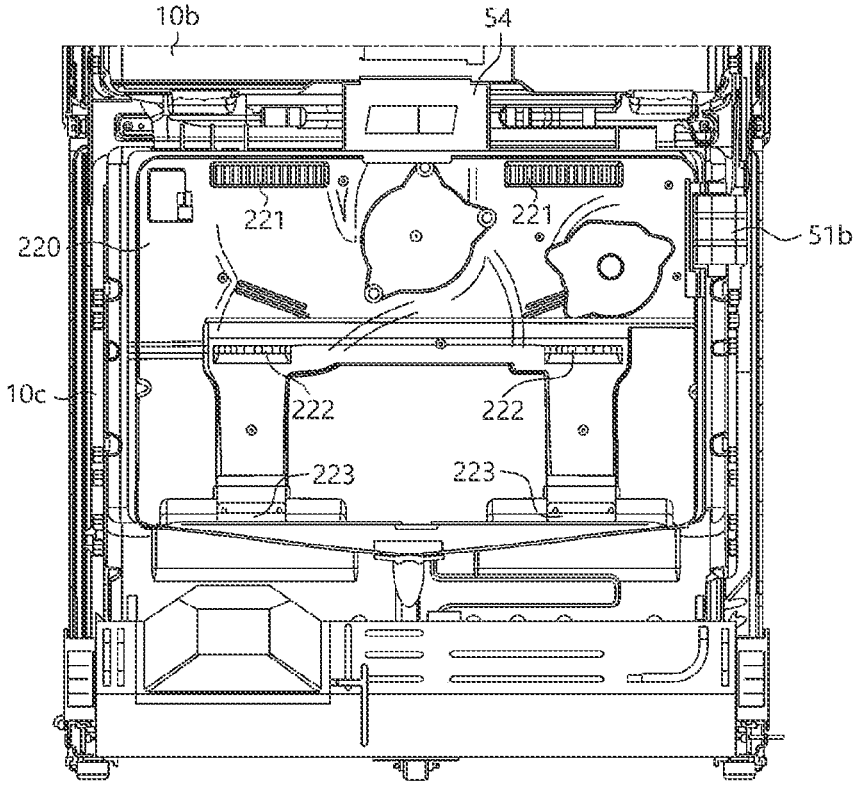
FIG. 14 is a front view showing a state in which a shroud is removed from a state in FIG. 13.
Figure 18:
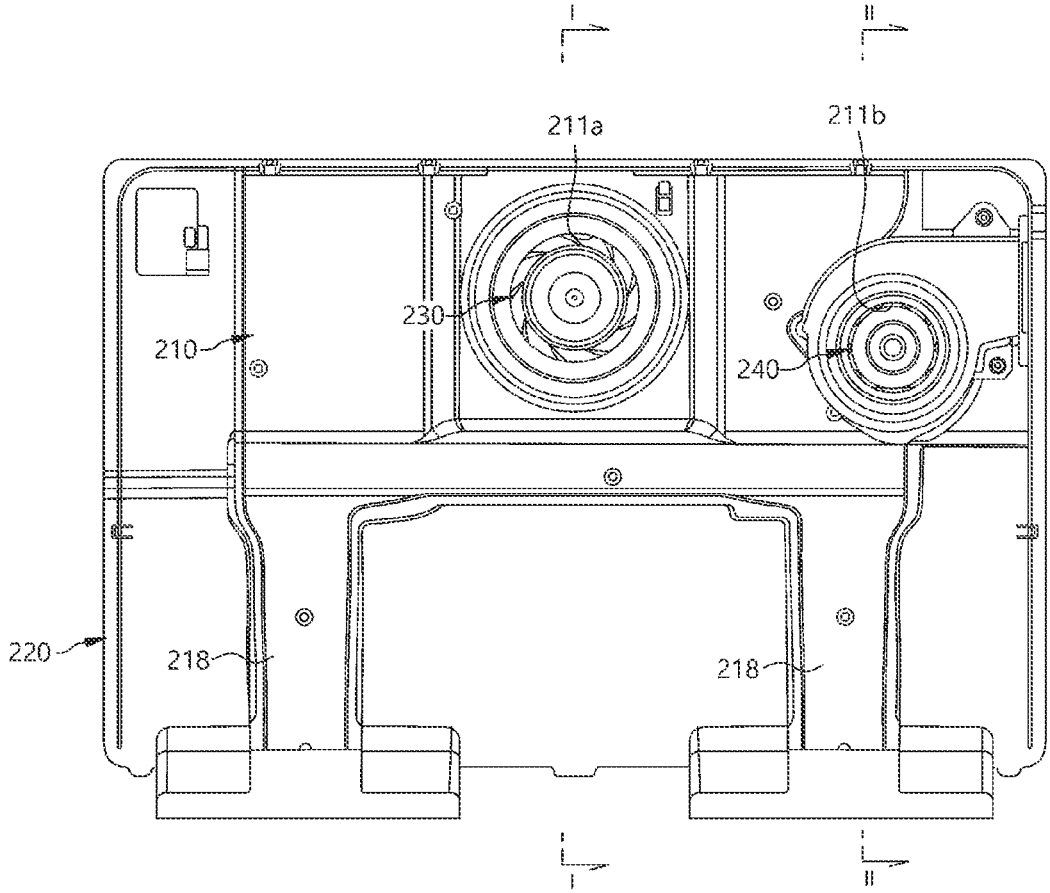
FIG. 18 is a front view showing the freezing compartment side grille fan assembly of the refrigerator according to the embodiment of the present disclosure.

Meanwhile, the ice-making fan module 240 is configured to be located closer to the freezing fan module 230 in comparison to the cool air outlet side of the cool air passage 213 for the ice-making compartment (referring to FIGS. 13 and 18). That is, as the ice-making fan 241 of the ice-making fan module 240 is located to be spaced apart from the cool air outlet side (open portion) of the cool air passage 213 for the ice-making compartment at a sufficient distance, the cool air passing through the cool air outlet side of the cool air passage 213 for the ice-making compartment may be prevented from un-passing smoothly through the cool air outlet side, and the cool air may be prevented from becoming turbulent due to the resistance caused by the flow of the cool air rotating along the rotation direction of the ice-making fan 241.

In addition, the ice-making fan 241 constituting the ice-making fan module 240 may be configured to rotate at a higher rotational speed than that of the freezing fan 231 constituting the freezing fan module 230.

That is, in the case of the freezing fan 231, since the freezing fan 231 supplies the cool air to the freezing compartment 12 in the front of the freezing fan 231, the freezing fan rotates at a rotation speed sufficient to provide a high air volume. However, in the case of the ice-making compartment 21, since the ice-making compartment 21 is located relatively father than the freezing compartment 12, the ice-making fan 241 is operated at a higher rotational speed than the freezing fan 231 so that the cool air is conveyed to the ice-making compartment 2.

In addition, the center of the ice-making fan module 240 is located lower than the center of the open portion at the cool air outlet side of the cool air passage 213 for the ice-making compartment.

That is, based on the center portion of the ice-making fan 241, the cool air discharged upward is guided to be supplied to the ice-making compartment 21 through the cool air passage 213 for the ice-making compartment. Considering the above structure, the center portion of the ice-making fan 241 is located lower than the center at the cool air outlet side (preferably, the lower surface of the cool air discharge portion) of the cool air passage 213 for the ice-making compartment, it is possible to allow the cool air blown from the ice-making fan 241 to be flow smoothly along the cool air passage 213 for the ice-making compartment.

Hereinbelow, according to the embodiment of the present disclosure, the temperature control process for the freezing compartment 12 and the ice-making compartment 21 of the refrigerator will be described in detail.

Figure 26:
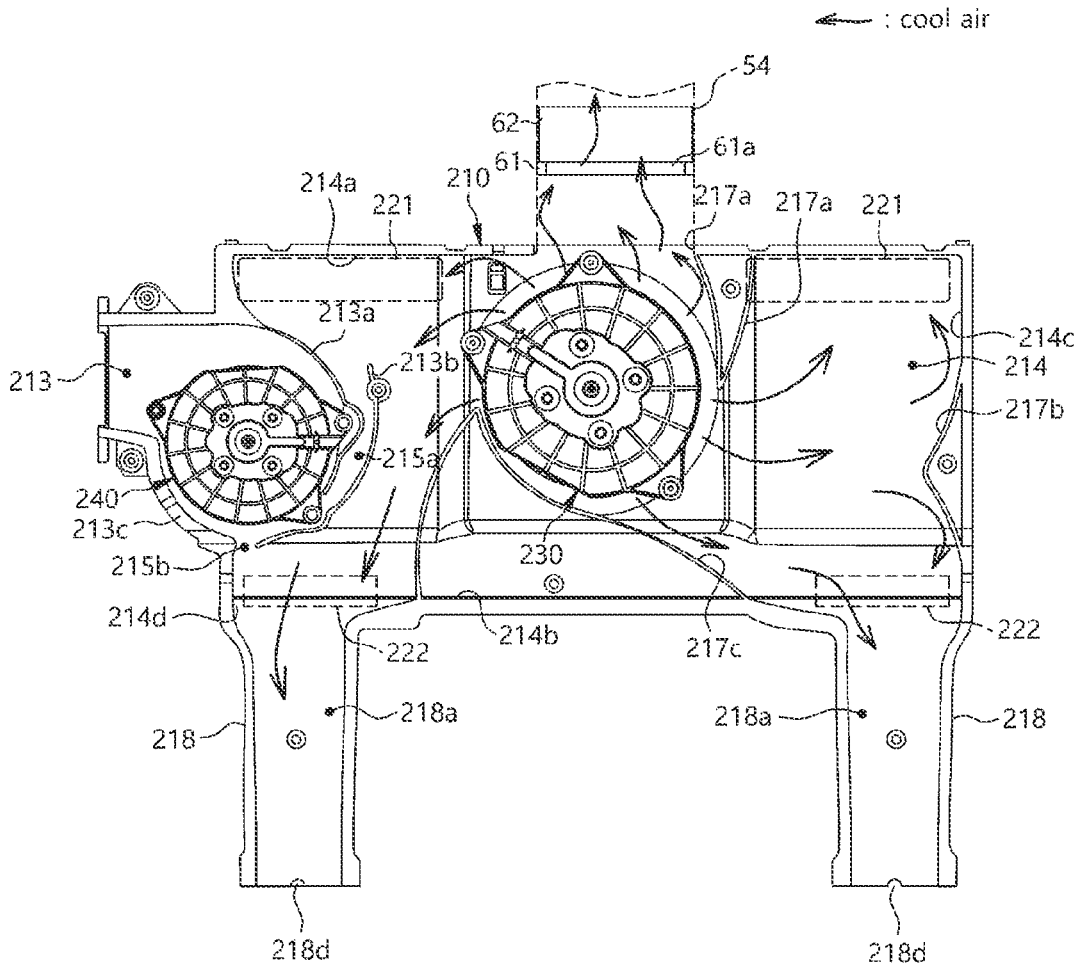
FIG. 26 is a rear view of the freezing compartment side grille fan assembly for showing a flow of cool air when the temperature in the refrigerating compartment of the refrigerator according to the embodiment of the present disclosure is controlled.
Figure 27:
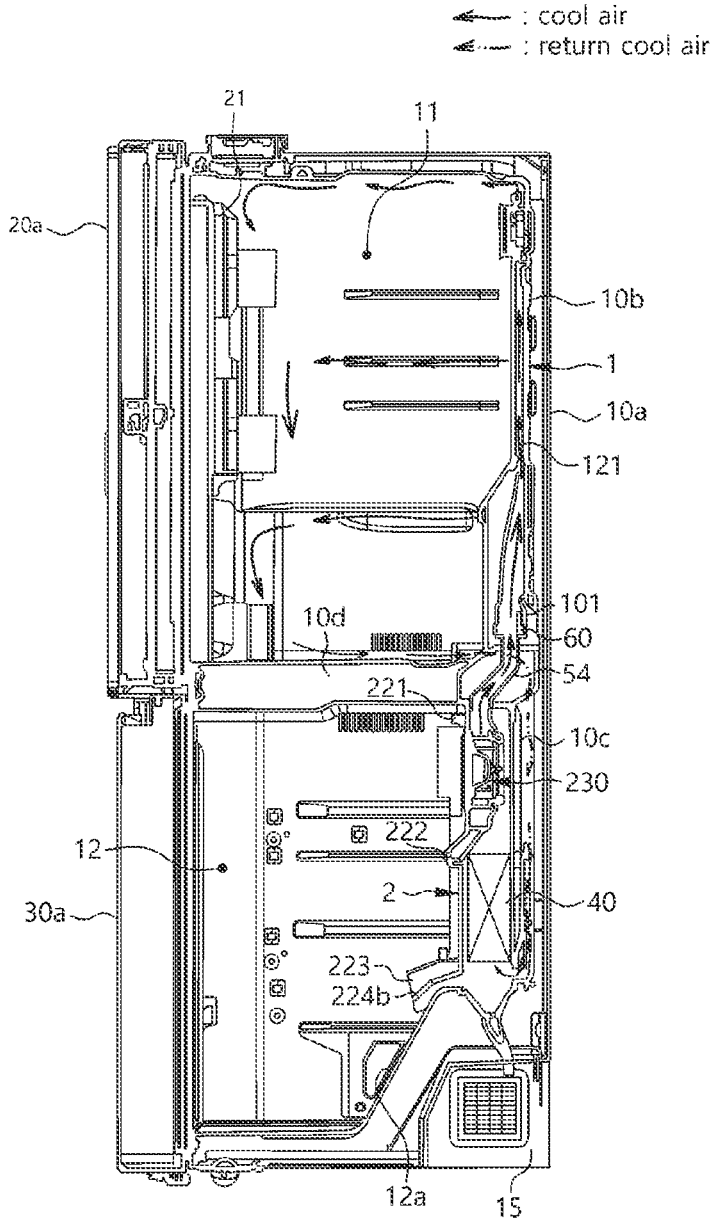
FIG. 27 is a side section view showing a flow of cool air when the temperature in the refrigerating compartment of the refrigerator according to the embodiment of the present disclosure is controlled.
Figure 28:
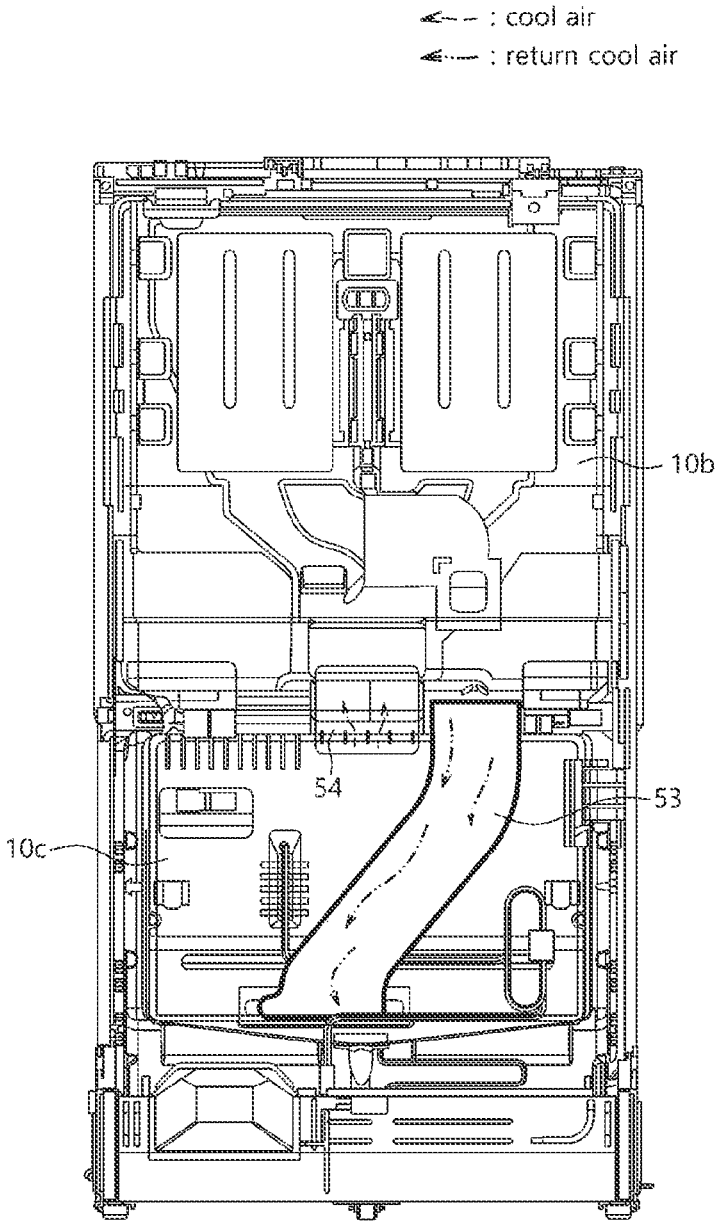
FIG. 28 is a state view showing flows of cool air of the connection duct and the recovery duct for the refrigerating compartment when the temperature in the refrigerating compartment of the refrigerator according to the embodiment of the present disclosure is controlled.
Figure 29:
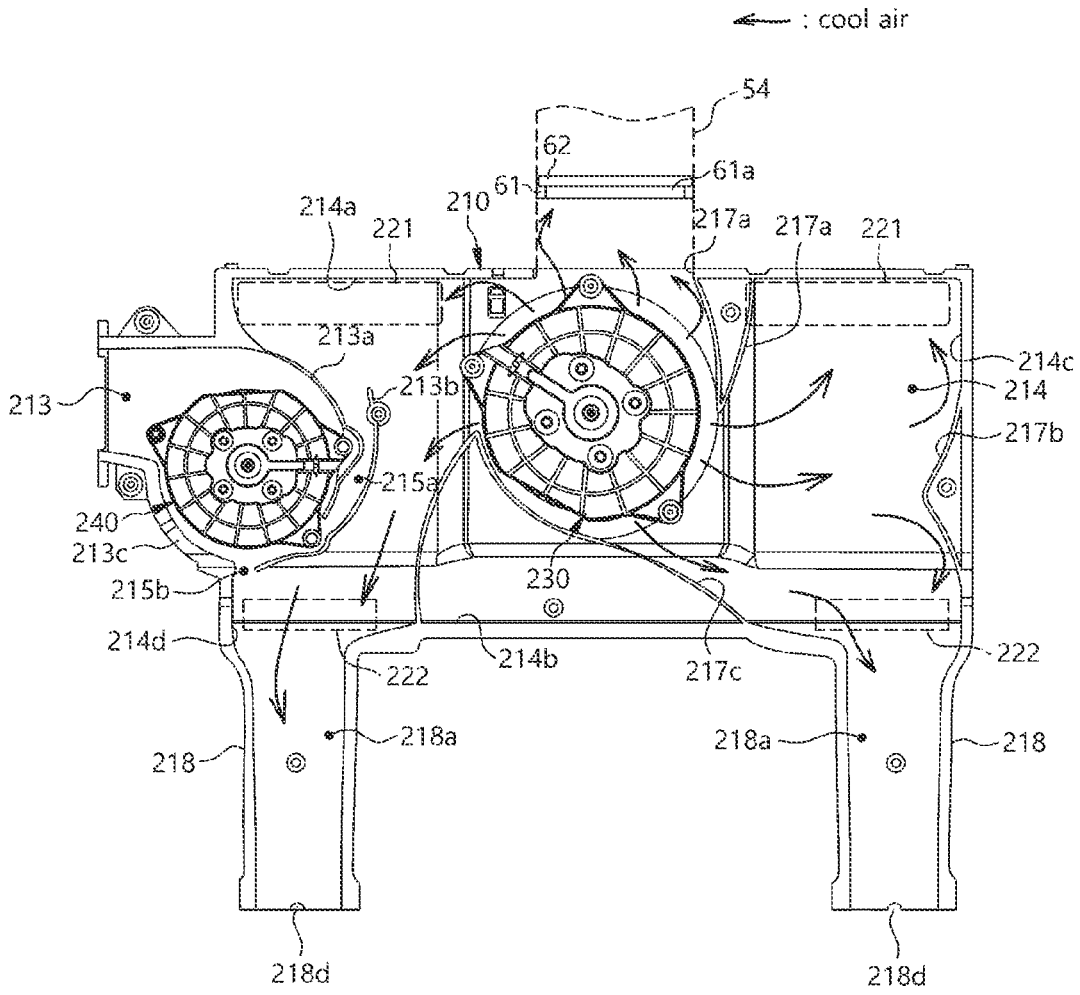
FIG. 29 is a state view from a front side of the shroud, the view showing a flow of cool air when the temperature in the freezing compartment of the refrigerator according to the embodiment of the present disclosure is control led.

The temperature control process of the refrigerating compartment 11 may be described with respect to FIGS. 26 to 28.

The temperature control of the refrigerating compartment 11 is performed by the operations of the freezing fan module 230, the compressor (not shown), and the passage opening and closing module 60.

That is, the passage opening and closing module 60 is operated, so that the connection duct 54 and the cool air passage 121 for the refrigerating compartment are opened to each other (referring to FIG. 16). Then, when the freezing fan 231 rotates and the compressor is operated by power supply to the freezing fan module 230, the heat exchange of the evaporator 40 is performed, and thus the operation for controlling the temperature of the refrigerating compartment 11 is performed.

When the freezing fan 231 of the freezing fan module 2:30 is operated, air in the freezing compartment 12 flows to pass through the evaporator 40 by a blowing force of the freezing fan 231, thereby being heat-exchanged while passing through the evaporator 40.

Further, the heat exchanged air (cool air) passes through the first inlet hole 211*a* of the shroud 210 and then flows into the cool air passage 214 for the freezing compartment.

The cool air flowing into and blown to the upper space in the cool air passage 214 for the freezing compartment is discharged through the cool air outlet 214*e* by guidance of the first guide 217*a*. Continuously, the connection duct 54 guides the cool air to be supplied into the cool air passage 121 for the refrigerating compartment.

Among the cool air blown in the radial direction of the freezing fan 231 while rotating along the circumferential direction of the freezing fan 231 by the operation of the freezing fan 231, remaining cool air that is not discharged through the cool air outlet 214*e* flows to portions in the cool air passage 214 for the freezing compartment, the portions where the two cool air out lets 221 for the upper compartment are located, and remaining cool air flowing along the two extension passages 218*a* to portions where the two cool air outlets 223 for the lower compartment are located. Then, the cool air is discharged into the upper compartment and lower compartment through the two cool air outlets 221 for the upper compartment and the two cool air outlets 223 for the lower compartment of the freezing compartment 12.

Further, the cool air supplied to the cool air passage 121 for the refrigerating compartment is supplied into the refrigerating compartment 11 through the cool air outlets 111, 112, and 113 while flowing along the cool air passage 121 for the refrigerating compartment, thereby refrigerating the object to be stored in the refrigerating compartment 11.

After the cool air refrigerates the object to be stored in the refrigerating compartment 11, the cool air flowing into a lower portion in the refrigerating compartment 11 repeats a circulation in which the cool air is recovered to the cool air inlet side of the evaporator 40 through the recovery duct 53 for the refrigerating compartment connected to the cool air inlet side thereof.

Meanwhile, when the inside of the refrigerating compartment 11 reaches a preset temperature by the above-described operation, the passage opening and closing module 60 is operated to block between the connection duct 54 and the cool air passage 121 for the refrigerating compartment. As a result, additional cool air supply to the refrigerating compartment 11 is not performed.

Hereinbelow, the process of controlling the temperature of the freezing compartment 12 will be described with reference to FIGS. 29 to 32.

The temperature control of the freezing compartment 12 is performed by the operations of the freezing fan module 230 and the compressor (not shown). That is, when the freezing fan 231 rotates and the compressor is operated by power supply to the freezing fan module 230, the heat exchange of the evaporator 40 is performed, and thus the operation for the temperature control of the freezing compartment 12 is performed. The passage opening and closing module 60 is operated to block between the connection duct 54 and the cool air passage 121 for the refrigerating compartment.

When the freezing fan 231 of the freezing fan module 230 is operated, air in the freezing compartment 12 flows to pass through the evaporator 40 the air blowing force of the freezing fan 231, thereby passing through the evaporator 40 and being heat-exchanged.

The heat exchanged air (cool air) passes through the first inlet hole 211*a* of the shroud 210 and then flows into the cool air passage 214 for the freezing compartment.

The cool air flowing into the cool air passage 214 for the freezing compartment and blown to the upper space in the cool air passage 214 for the freezing compartment flows into the portions in the cool air passage 214 for the freezing compartment, the portion where the two cool air outlets 221 for the upper compartment are located, by guidance of the first guide 217*a*, and then the cool air is discharged to the upper compartment of the freezing compartment 12 through the cool air outlet 221 for the upper compartment.

The cool air blown to the lower side in the cool air passage 214 for the freezing compartment flows into the port ions where the two cool air outlets 222 for the middle compartment are located, by guidance of the second guide 217*b*. Then, the cool air is discharged to the middle compartment of the freezing compartment 12 through the two cool air outlets 222 for the middle compartment. Among the cool air flowing by the guidance of the second guide 217*b*, cool air flowing into a portion where either cool air outlet 222 for the middle compartment is located (the side opposite to the side where the ice-making fan is located) is guided in an up and down direction by guidance of the third guide 217*c* at the side, part of the cool air flows into the cool air outlet 221 for the upper compartment at the side, and the remaining of the cool air flows into the cool air outlet 222 for the middle compartment at the side.

In addition, the cool air flowing into the two cool air outlets 222 for the middle compartment by the guidance of the second guide 217*b* and the third guide 217*c* is partially discharged to the middle compartment of the freezing compartment 12 through the two cool air outlets 222 for the middle compartment. The remaining cool air flows into the sides where the two cool air outlets 223 for the lower compartment are located by guidance of the extension passage 218*a*, and then is discharged to the lower compartment of the freezing compartment 12 through the two cool air outlets 223 for the lower compartment.

Therefore, the cool air is evenly supplied to all of the upper, middle, and lower compartments of both sides in the freezing compartment 12.

Further, the cool air supplied into the two freezing compartments 12 by passing through the cool air outlets 221, 222, and 223 flows in the freezing compartment 12, and then the two suction guides 224*a* and 224*b* formed in the grille panel 220 guides the cool air to be recovered to the cool air inlet side of the evaporator 40.

Meanwhile, during the temperature control of the freezing compartment 12, the ice-making fan 241 may also be operated.

That is, in the case of the ice-making operation, the ice-making fan 241 is set to be always operated except for special conditions (e.g., when ice is in full in the ice-making compartment). Considering the above state, the ice-making operation may be continuously performed during the freezing operation.

However, when the ice-making operation is performed when the freezing operation is performed, the flow of cool air flowing through the second inlet hole 211*b* and the cool air passage 213 for the ice-making compartment in order is generated by the operation of the ice-making fan 241.

In particular, part of the cool air generated by the operation of the ice-making fan 241 is supplied into the cool air passage 214 for the freezing compartment through the upper shared passage 215*a*. The remaining cool air is supplied into the ice-making compartment 21 through the cool air duct 51 for the ice-making compartment connected to the cool air passage 213 for the ice-making compartment.

That is, cool air passing through the second inlet hole 211*b* and blown to the first area 216*a* of the cool air passage 213 for the ice-making compartment passes through the upper shared passage 215*a* to be supplied to the cool air passage 214 for the freezing compartment. Cool air passing through the second inlet hole 211*b* and blown to the second area 216*b* of the cool air passage 213 for the ice-making compartment passes through the lower shared passage 215*b* to be supplied to the cool air passage 214 for the freezing compartment. Cool air passing through the second inlet hole 211*b* and blown to the third area 216*c* of the cool air passage 213 for the ice-making compartment is supplied to the ice-making compartment 21 through the cool air duct 51 for the ice-making compartment connected to the cool air outlet side of the cool air passage 213 for the ice-making compartment.

Figure 30:
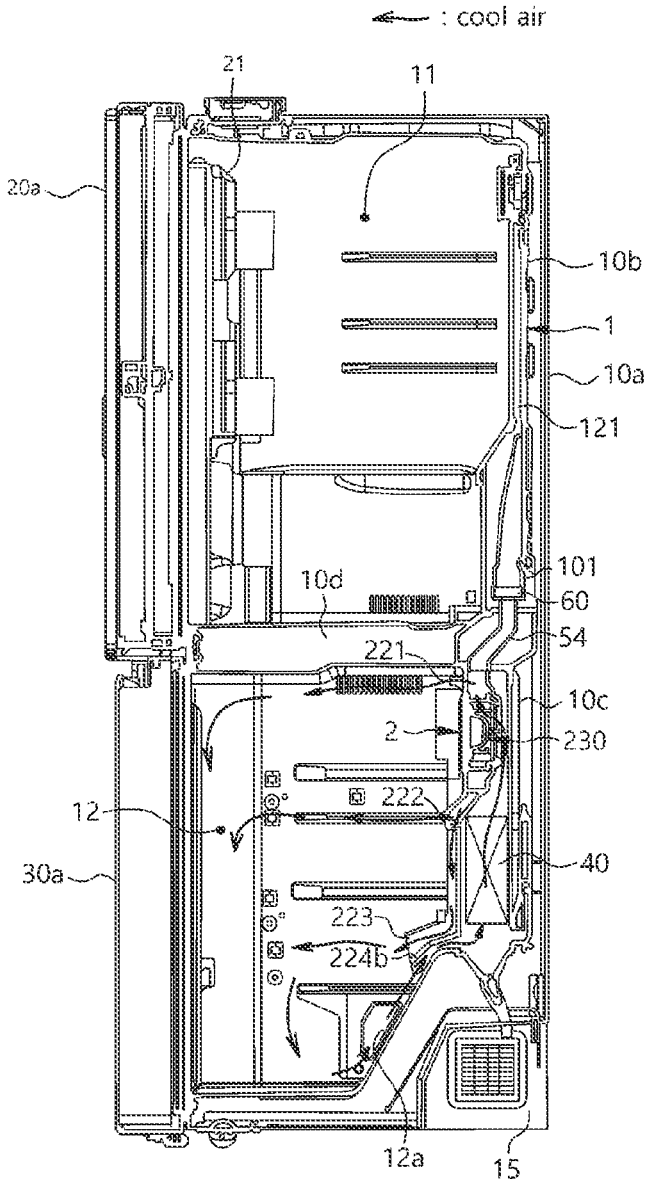
FIG. 30 is a side section view showing a flow of cool air when the temperature in the freezing compartment of the refrigerator according to the embodiment of the present disclosure is controlled.
Figure 31:
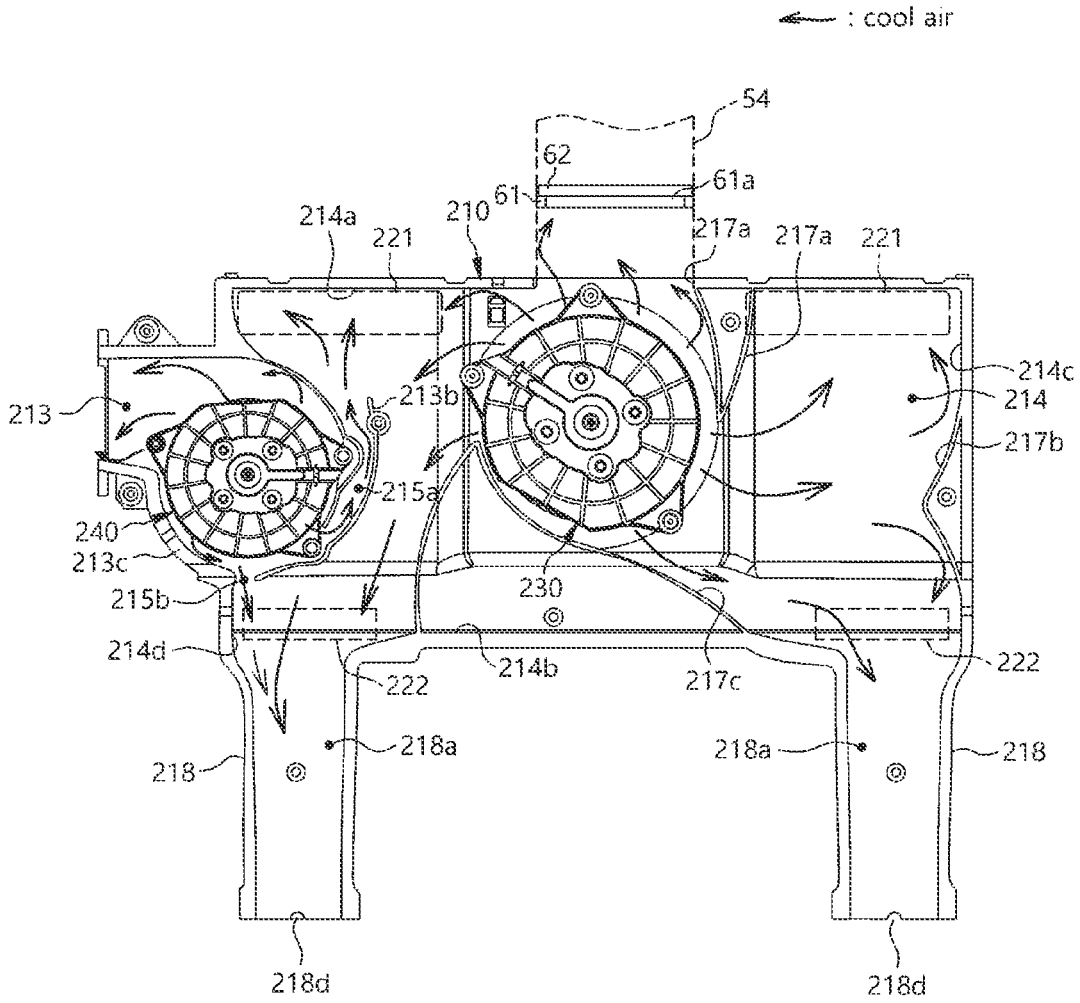
FIG. 31 is a state view from the front side of the shroud, the view showing a flow of cool air when the freezing compartment and the ice-making compartment of the refrigerator according to the embodiment of the present disclosure are operated at the same time.
Figure 32:
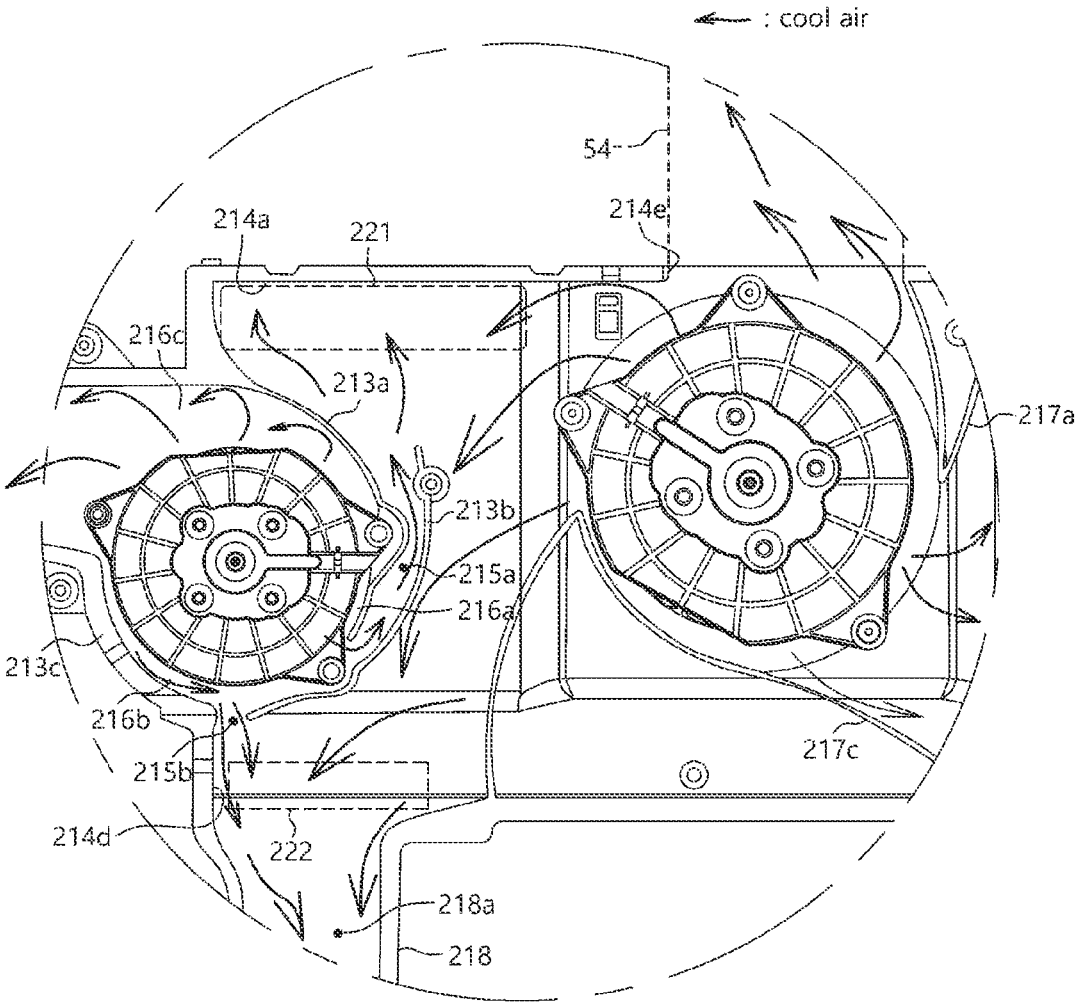
FIG. 32 is a main-part enlarged view from the front side of the shroud, the view showing the flow of cool air when the freezing compartment and the ice-making compartment of the refrigerator according to the embodiment of the present disclosure are operated at the same time.

Therefore, in the freezing compartment 12, not only the cool air blown by the operation of the freezing fan 231 but also the cool air blown by the operation of the ice-making fan 241 are supplied, so that sufficient cool air may be supplied. The above structure is as shown in FIGS. 30 and 31.

In particular, the cool air supplied through the upper shared passage 215*a* is provided to the upper compartment of one space in the both side spaces in the freezing compartment 12, the space at a side communicating with the recovery duct 52 for the ice-making compartment. Whereby, sufficient cool air may be supplied to the freezing compartment 12.

In addition, the cool air supplied through the lower shared passage 215*b* is provided to a lower compartment of one space in the both side spaces of the freezing compartment 12, the space at a side communicating with the recovery duct 52 for the ice-making compartment. Therefore, even when the cool air passing through the ice-making compartment 21 through the recovery duct 52 for the ice-making compartment is recovered, a sudden change of the temperature in the space is prevented. In addition, the opposite spaces in the freezing compartment 12 may be maintained within the same (or similar) temperature range.

Further, when the freezing operation (or ice-making operation) is performed or each operation is stopped, condensed water is generated due to temperature difference between the cool air passage 213 for the ice-making compartment and the refrigerating compartment 11, or the cool air duct 51 for the ice-making compartment and the refrigerating compartment 11. The generated condensed water flows down the second circumferential passage rib 213*b* of the cool air passage 213 for the ice-making compartment along the cool air duct 51 for the ice-making compartment.

Then, the condensed water flows down the extension passage 218*a* through the lower shared passage 215*b* formed in the second circumferential passage rib 213*b*. Continuously, the condensed water flows along the extension passage 218*a* and is discharged to the outside of the freezing compartment side grille fan assembly 2 through the drainage hole 218*d* formed in the extension passage 218*a* where the condensed water flows.

Accordingly, a malfunction of the ice-making fan 241 due to the condensed water freezing in the cool air passage 213 for the ice-making compartment without being drained may be prevented.

Hereinbelow, the operation for controlling the temperature in the ice-making compartment 21 (ice-making operation) will be described with reference to FIGS. 33 to 36.

The temperature control of the ice-making compartment 21 is performed by the operation of the ice-making fan 241 due to power supply to the ice-making fan module 240. At this time, the compressor may be operated or stopped in response to the operating conditions of the freezing compartment 12.

Figure 33:
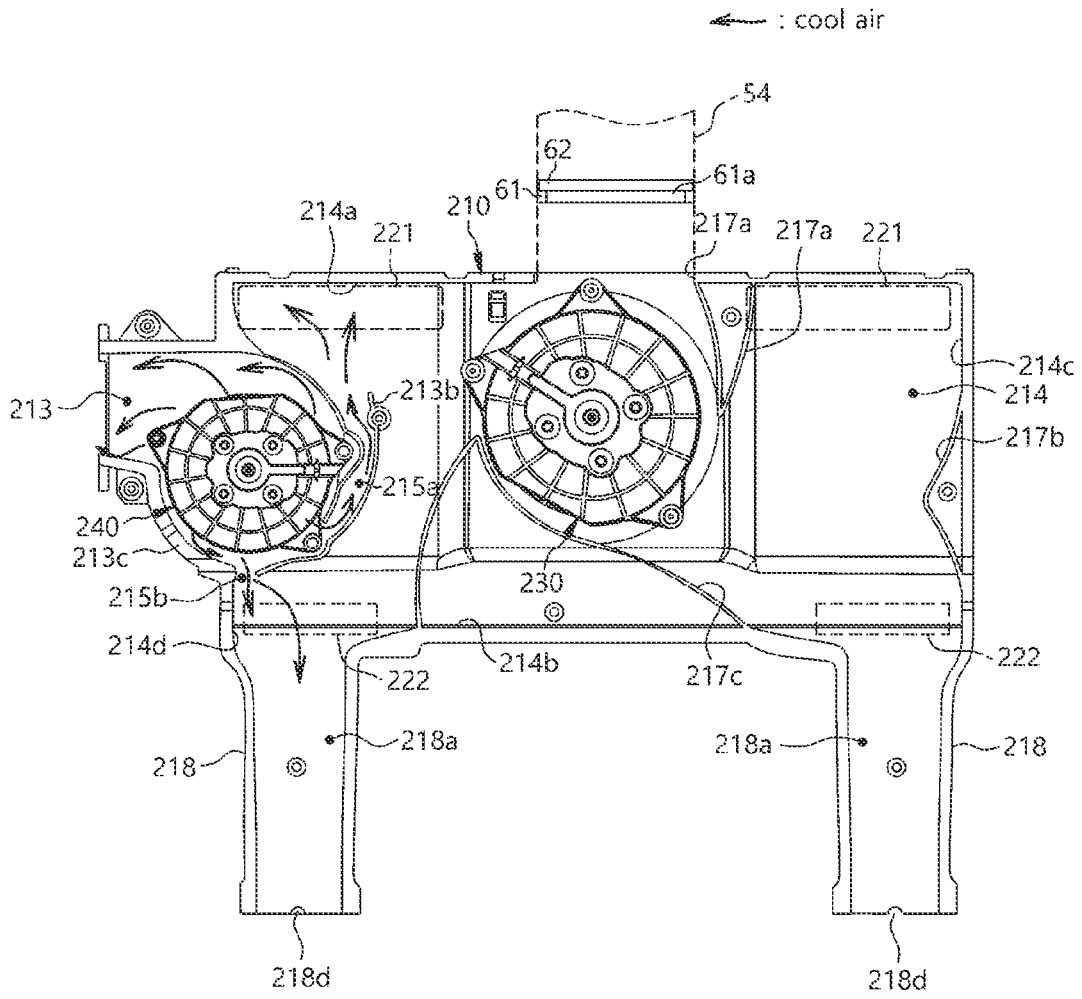
FIG. 33 is a state view from the front side of the shroud, the view showing a flow of cool air when the temperature in the ice-making compartment of the refrigerator according to the embodiment of the present disclosure is control led.
Figure 34:
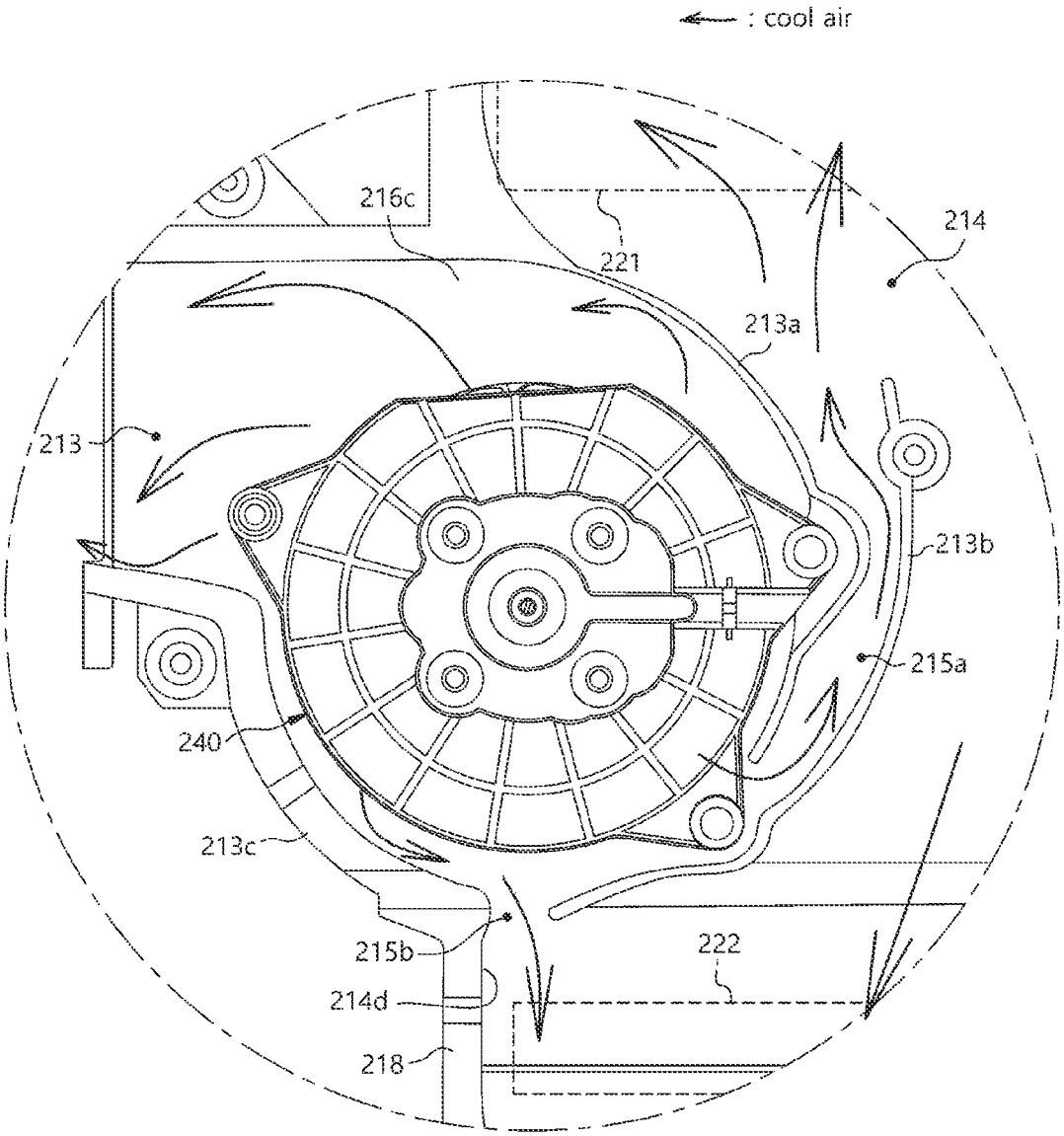
FIG. 34 is a main-part enlarged view from the front side of the shroud, the view showing the flow of cool air when the temperature in the ice-making compartment of the refrigerator according to the embodiment of the present disclosure is controlled.

When the ice-making fan 241 is operated, air in the freezing compartment 12 passes through the evaporator 40 and passes through the second inlet hole 211*b* of the shroud 210 by the air blowing force of the ice-making fan 241, and then flows into the first area 216*a*, the second area 216*b*, and the third area 216*c* of the cool air passage 213 for the ice-making compartment. Continuously, the air is discharged from the cool air passage 213 for the ice-making compartment through the communication portions with the areas 216*a*, 216*b*, and 216*c*. The above operation is as shown in FIGS. 33 and 34.

The cool air flowing into the first area 216*a* by the operation of the ice-making fan 241 passes through the upper shared passage 215*a* to be supplied to the upper surface side of the cool air passage 214 for the freezing compartment. The cool air blown to the second area 216*b* passes through the lower shared passage 215*b* to be supplied to the extension passage 218*a*. The cool air blown to the third area 216*c* passes through the cool air duct 51 for the ice-making compartment to be supplied to the ice-making compartment 21.

Figure 35:
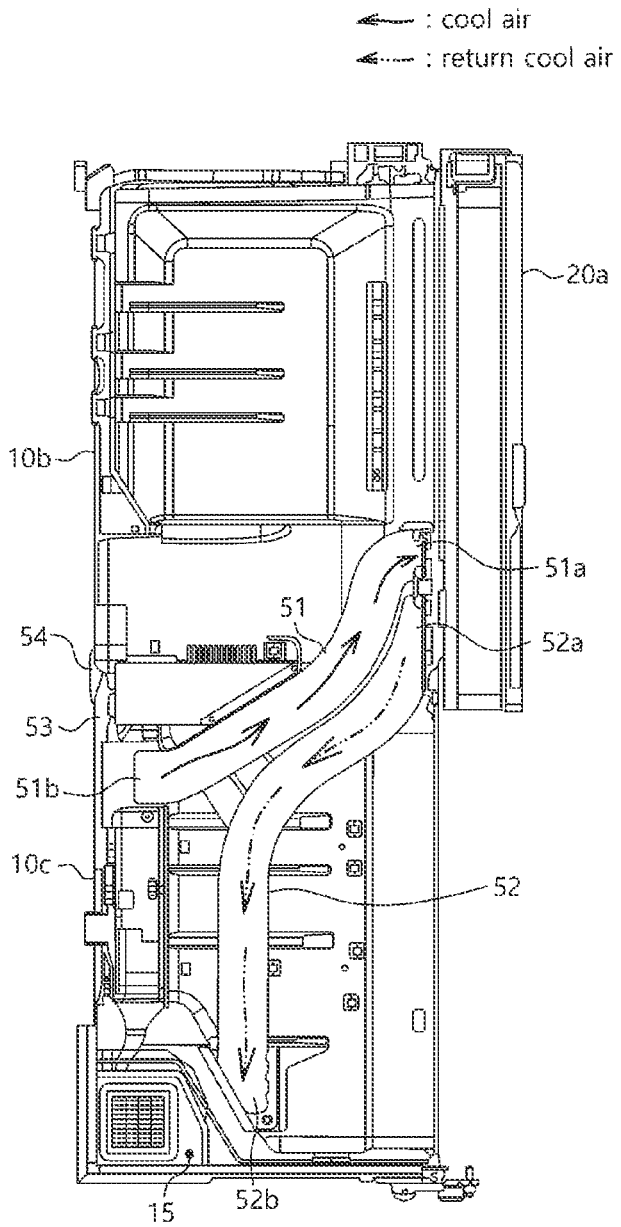
FIG. 35 is a side view showing the flow of cool air when the temperature in the ice-making compartment of the refrigerator according to the embodiment of the present disclosure is controlled.
Figure 36:
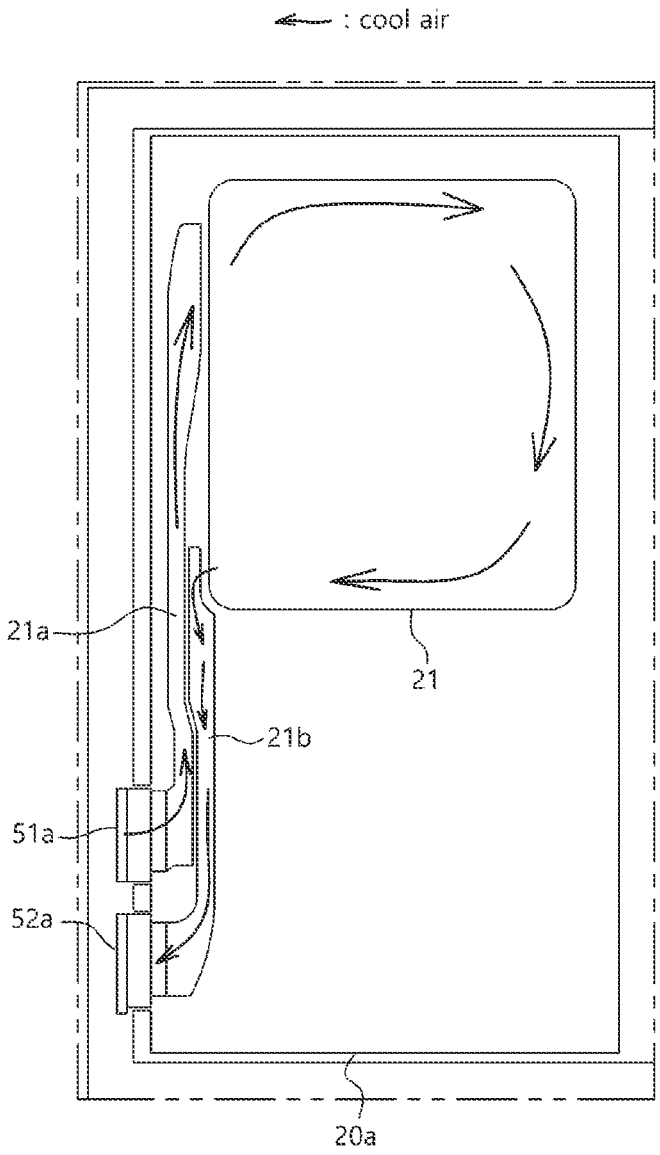
FIG. 36 is a state view schematically showing the flow of cool air in the ice-making compartment when the temperature in the ice-making compartment of the refrigerator according to the embodiment of the present disclosure is controlled.

In addition, the cool air passing through the upper shared passage 215*a* and supplied to the cool air passage 214 for the freezing compartment is supplied to the freezing compartment 12 through the cool air outlet 221 for the upper compartment while being blown toward the cool air outlet 221 for the upper compartment in the cool air passage 214 for the freezing compartment. The cool air passing through the lower shared passage 215*b* and supplied to the cool air passage 214 for the freezing compartment is supplied to the freezing compartment 12 through the cool air outlet 223 for the lower compartment while flowing along the side wall surface of the extension passage 218*a*. The above operations are as shown in FIGS. 35 and 36.

In particular, the cool air passing through the second inlet hole 211*b* and supplied to the cool air passage 213 for the ice-making compartment by the air blowing force of the ice-making fan 241 is discharged to the third area 216*c*, which is the upper portion of the ice-making fan 241, and then the cool air flows along the cool air passage 213 for the ice-making compartment into the cool air outlet side. At this time, since the cool air flows along a sufficient distance from the third area 216*c* to the cool air outlet side, the flow resistance caused by the third area 216*c* and the cool air outlet side adjacent to each other may be reduced.

Accordingly, the inside of the freezing compartment 12 maintains a pressure state similar to a pressure state of the cool air passage 213 for the ice-making compartment by the cool air supplied through the upper shared passage 215*a* and the lower shared passage 215*b*. That is, since the pressures of the freezing compartment 12 and the ice-making compartment 21 are roughly balanced, even when only the ice-making fan 241 is operated for the ice-making operation, the cool air in the freezing compartment 12 may be prevented from (or, be minimized in) passing through the cool air passage 214 for the freezing compartment and the first inlet hole 211*a* in reverse and flowing into the second inlet hole 211*b* and the cool air passage 213 for the ice-making compartment.

Meanwhile, when the cool air heat-exchanged while passing through the evaporator 40 passes through the second inlet hole 211*b* and is discharged in the radial direction of the ice-making fan 241, the cool air may pass through the second inlet hole 211*b* in reverse due to the flow resistance.

However, the second inlet hole 211*b* is configured to cover each impeller 241*c* of the ice-making fan 241 (or, to cover at least half of each impeller), so that the cool air blown from the ice-making fan 241 is prevented from a back flow in which the cool air is discharged through the second inlet hole 211*b*. Further, the cool air may be blown to the cool air passage 213 for the ice-making compartment with a blowing pressure higher than a blowing pressure of the cool air passing through the first inlet hole 211*a* and blown along the cool air passage 214 for the freezing compartment.

By the high blowing pressure, the cool air is smoothly supplied to the ice-making compartment 21 through the cool air duct 51 for the ice-making compartment connected to the cool air passage 213 for the ice-making compartment.

In addition, the cool air discharged to the third area 216*c* flows toward the second area 216*b* located in the rotating direction of the ice-making fan 241. However, considering that the third area 216*c* and the second area 216*b* are partitioned from each other by the ice-making fan module 240, the whole cool air discharged to the third area 216*c* flows toward the cool air outlet side of the cool air passage 213 for the ice-making compartment by the guidance of the cool air passage 213 for the ice-making compartment.

Accordingly, the amount of the cool air supplied to the ice-making compartment 21 is less than that of the cool air supplied to the freezing compartment 12, but the cool air supplied to the ice-making compartment 21 may be smoothly conveyed to the ice-making compartment 21 by the high blowing pressure.

Further, the cool air supplied to the ice-making compartment 21 freezes water (or other beverages) in an ice tray (not shown) while flowing in the ice-making compartment 21.

The cool air flowing in the ice-making compartment 21 flows into the recovery duct 52 for the ice-making compartment, and continuously, the cool air is recovered to the freezing compartment 12 by guidance of the recovery duct 52 for the ice-making compartment.

Then, the cool air recovered to the freezing compartment 12 is directly suctioned into the first suction guide 224*a* located opposite to the freezing compartment 12 and is recovered to the cool air inlet side of the evaporator 40.

Accordingly, the temperature in the ice-making compartment 21 is controlled by the above-described repeated circulation of air (cool air).

As a result, the shared passages 215*a* and 215*b* are provided in the refrigerator of the present disclosure, so that the cool air passage 214 for the freezing compartment and the cool air passage 213 for the ice-making compartment are shared with each other. Accordingly, even when the freezing fan 231 and the ice-making fan 241 are operated at the same time, sufficient cool air may be supplied to the freezing compartment 12, and when only the ice-making fan 241 is operated, the back flow of cool air from the freezing compartment 12 is prevented.

The refrigerator of the present disclosure is configured such that the open portion of the cool air outlet side of the shared passage 215*a*, 215*b* does not face the freezing fan module 230. Accordingly, the cool air provided from the cool air passage 213 for the ice-making compartment through the shared passage 215*a*. 215*b* does not interfere with the flow of the cool air flowing in the cool air passage 214 for the freezing compartment.

The refrigerator of the present disclosure is configured such that the lower shared passage 215*b* is formed in a lower surface (the second circumferential passage rib) of the installation port ion of the ice-making fan module 240, and the extension passage 215*a*, 215*b* extended to the lower compartment of the freezing compartment 12 is additionally formed in the shroud 210, so that sufficient cool air may be supplied to the lower compartment of the freezing compartment 12. In particular, the drainage hole 218*d* is additionally formed in the extension passage 218*a*, and the lower shared passage 215*b* is formed by penetrating between the second circumferential passage rib 213*b* and the wall surface of the shroud 210, so that condensed water or moisture in the installation portion of the ice-making fan module 240 may be smoothly discharged to the outside of the freezing compartment 12.

The refrigerator of the present disclosure is configured to have the guide 217*a*, 217*b*, 217*c* formed on each wall surface 214*a*, 214*b*, 214*c*, 214*d* in the cool air passage 214 for the freezing compartment. Accordingly, the cool air flowing in the cool air passage 214 for the freezing compartment may be supplied differently for each portion in the freezing compartment 12, thereby improving the freezing efficiency.

The refrigerator of the present disclosure is configured to supply the cool air to the cool air passage 121 for the refrigerating compartment of the refrigerating compartment side grille fan assembly 1 through the cool air outlet 214*e* formed in the upper wall surface 214*a* of the cool air passage 214 for the freezing compartment and the connection duct 54 connected to the cool air out let 214*e*. Accordingly, the single evaporator 40 may selectively supply cool air to the refrigerating compartment, the freezing compartment, and the ice-making compartment.

The invention claimed is:

1. A refrigerator comprising:

a cabinet having a refrigerating compartment and a freezing compartment;

a refrigerating compartment door having an ice-making compartment;

an evaporator located at the freezing compartment and configured to cool air;

a freezing compartment side grille fan assembly located at a front of the evaporator;

a refrigerating compartment side grille fan assembly connected to the freezing compartment side grille fan assembly; and a connection duct that connects the freezing compartment side grille fan assembly to the refrigerating compartment side grille fan assembly and is configured to transfer air from the freezing compartment side grille fan assembly to the refrigerating compartment side grille fan assembly, wherein the freezing compartment side grille fan assembly includes:

a freezing fan and an ice-making fan, a first cool air passage configured to guide air blown by the freezing fan, a second cool air passage configured to guide air blown by the ice-making fan, extended passages that are defined at opposite end portions of a lower side of the first cool air passage, respectively, each of the extended passages extending to a lower portion of the freezing compartment, and a shared passage configured to communicate the air blown by the freezing fan or the ice-making fan between the first cool air passage and the second cool air passage, the shared passage including a lower shared passage configured to supply a part of the air to any one of the extended passages.

2. The refrigerator of claim 1, wherein the freezing fan is located at a center portion of the freezing compartment side grille fan assembly, wherein the ice-making fan is located at one side of the freezing fan, and wherein the shared passage has a cool air outlet side having an open portion that is not oriented toward the freezing fan.

3. The refrigerator of claim 2, wherein the freezing compartment side grille fan assembly further comprises:

a grille panel that defines a front wall surface of the freezing compartment side grille fan assembly; and a shroud that faces the grille panel and defines a rear wall surface of the freezing compartment side grille fan assembly, the shroud supporting the freezing fan and the ice-making fan, and wherein the first cool air passage and the second cool air passage are defined at at least one surface among facing surfaces of the grille panel and the shroud.

4. The refrigerator of claim 3, wherein the freezing compartment side grille fan assembly has a cool air outlet that is in fluid communication with a part of the first cool air passage and is connected to the refrigerating compartment side grille fan assembly through the connection duct.

5. The refrigerator of claim 4, wherein the cool air outlet of the freezing compartment side grille fan assembly is defined at a portion of an upper surface of the freezing compartment side grille fan assembly above the freezing fan.

6. The refrigerator of claim 5, wherein the freezing compartment side grille fan assembly further comprises an upper guide located at the upper surface of the freezing compartment side grille fan assembly and configured to guide the air blown by the freezing fan to the cool air outlet and an upper space of the first cool air passage.

7. The refrigerator of claim 1, wherein the freezing compartment side grille fan assembly further comprises a first guide located in the first cool air passage, the first guide including a second guide configured to guide the air in the first cool air passage to opposite sides of the first cool air passage.

8. The refrigerator of claim 7, wherein the second guide is configured to guide the air in the first cool air passage toward each of the extension extended passages.

9. The refrigerator of claim 1, wherein the freezing compartment side grille fan assembly further comprises a passage rib that separates the first cool air passage and the second cool air passage from each other, and wherein the shared passage further includes an upper shared passage that is defined by the passage rib and configured to supply a part of the air blown by the ice-making fan from the second cool air passage to an upper portion of the first cool air passage.

10. The refrigerator of claim 9, wherein the passage rib comprises:

a first circumferential passage rib that surrounds an upper circumference of the ice-making fan; and a second circumferential passage rib that surrounds a lower circumference of the ice-making fan.

11. The refrigerator of claim 10, wherein a lower end of the first circumferential passage rib and an upper end of the second circumferential passage rib are spaced apart from each other, and wherein the upper shared passage includes a space defined between the first and second circumferential passage ribs.

12. The refrigerator of claim 11, wherein an upper portion of the second circumferential passage rib surrounds an outer circumferential surface of the first circumferential passage rib and further extends upward relative to the lower end of the first circumferential passage rib such that the upper shared passage faces an upper side of the first cool air passage.

13. The refrigerator of claim 12, wherein the upper end of the second circumferential passage rib is located higher than a center height of the freezing fan.

14. The refrigerator of claim 12, wherein a horizontal distance between the upper end of the second circumferential passage rib and the lower end of the first circumferential passage rib increases as the second circumferential passage rib extends upward.

15. The refrigerator of claim 1, wherein one of the extended passages is located at a lower portion of the second cool air passage and configured to receive the air from the lower shared passage.

16. The refrigerator of claim 10, wherein the freezing compartment side grille fan assembly further comprises opposing wall surfaces that face each other, the first cool air passage being defined between the opposing wall surfaces, and wherein the lower shared passage includes a space defined between a lower end of the second circumferential passage rib and one of the opposite wall surfaces that is positioned closer to the ice-making fan than to the freezing fan.

17. The refrigerator of claim 1, further comprising a recovery duct configured to guide air from the refrigerating compartment to a cool air inlet side of the evaporator.

18. The refrigerator of claim 17, wherein the recovery duct has:

a first end connected to a lower end of the refrigerating compartment and located at a rear surface of the cabinet; and a second end connected to the cool air inlet side of the evaporator and located at the rear surface of the cabinet.

19. The refrigerator of claim 18, wherein the connection duct connects a center portion of a lower portion of the refrigerating compartment side grille fan assembly to a center portion of an upper portion of the freezing compartment side grille fan assembly, and wherein the first end of the recovery duct is located at a side of the connection duct and connected to the lower end of the refrigerating compartment.

* * * * *